US010074261B2

(12) United States Patent
Buck, Jr. et al.

(10) Patent No.: US 10,074,261 B2
(45) Date of Patent: Sep. 11, 2018

(54) SYSTEMS AND METHODS FOR UTILIZING INFORMATION TO MONITOR TARGETS

(71) Applicant: BI Incorporated, Boulder, CO (US)

(72) Inventors: James J. Buck, Jr., Longmont, CO (US); Joseph P. Newell, Louisville, CO (US); Cady Lynn Brooks, Nederland, CO (US)

(73) Assignee: BI Incorporated, Boulder, CO (US)

( * ) Notice: Subject to any disclaimer, the term of this patent is extended or adjusted under 35 U.S.C. 154(b) by 319 days.

(21) Appl. No.: 14/228,198

(22) Filed: Mar. 27, 2014

(65) Prior Publication Data

US 2015/0048948 A1 Feb. 19, 2015

Related U.S. Application Data

(60) Provisional application No. 61/866,000, filed on Aug. 14, 2013.

(51) Int. Cl.
*G08B 21/22* (2006.01)

(52) U.S. Cl.
CPC ..... *G08B 21/22* (2013.01)

(58) Field of Classification Search
CPC ..... G08B 21/22; G08B 25/00; G08G 1/127; G08G 1/207; G01C 21/34; G07C 9/00896; G07C 9/00309; G07C 2009/0092; E05C 19/186; E05B 83/08; E05B 39/005
See application file for complete search history.

(56) References Cited

U.S. PATENT DOCUMENTS

| | | | | |
|---|---|---|---|---|
| 6,317,685 | B1 * | 11/2001 | Kozak | G01C 21/3407 340/905 |
| 7,930,927 | B2 | 4/2011 | Cooper et al. | |
| 8,451,131 | B2 * | 5/2013 | Ghazarian | G08B 21/0258 340/539.11 |
| 8,493,219 | B2 | 7/2013 | Buck et al. | |
| 8,576,065 | B2 | 11/2013 | Buck et al. | |
| 8,624,727 | B2 * | 1/2014 | Saigh | H04W 4/025 340/539.1 |
| 8,629,776 | B2 | 1/2014 | Buck et al. | |
| 8,657,744 | B2 | 2/2014 | Rompa et al. | |
| 9,197,595 | B1 * | 11/2015 | Sandler | H04L 61/2007 |
| 9,240,118 | B2 | 1/2016 | Melton | |
| 9,241,659 | B2 | 1/2016 | Rompa et al. | |
| 2008/0186165 | A1 * | 8/2008 | Bertagna | G08B 21/0227 340/539.13 |
| 2008/0291011 | A1 * | 11/2008 | Knight | G08B 21/0252 340/539.13 |
| 2010/0123589 | A1 * | 5/2010 | Buck | G08B 21/0261 340/573.4 |
| 2011/0154887 | A1 | 6/2011 | Cooper et al. | |
| 2013/0006066 | A1 | 1/2013 | Melton | |
| 2015/0061864 | A1 | 3/2015 | Buck et al. | |

(Continued)

OTHER PUBLICATIONS

U.S. Appl. No. 13/919,862, filed Jun. 17, 2013, Newell et al.
U.S. Appl. No. 14/966,135, filed Dec. 11, 2015, Donald A. Melton.

*Primary Examiner* — Ryan Sherwin
(74) *Attorney, Agent, or Firm* — Hamilton, DeSanctis & Cha

(57) ABSTRACT

Various embodiments of the present invention provide systems and method for monitoring movement in relation to locations about which data is available from one or more sources.

31 Claims, 18 Drawing Sheets

(56) References Cited

U.S. PATENT DOCUMENTS

| | | | |
|---|---|---|---|
| 2015/0078622 | A1 | 3/2015 | Buck et al. |
| 2015/0131085 | A1 | 5/2015 | Cooper et al. |
| 2015/0228184 | A1 | 8/2015 | Buck et al. |
| 2015/0279200 | A1 | 10/2015 | Buck et al. |
| 2015/0327214 | A1 | 11/2015 | Buck et al. |

* cited by examiner

651

854

SYSTEMS AND METHODS FOR UTILIZING INFORMATION TO MONITOR TARGETS

CROSS REFERENCE TO RELATED APPLICATIONS

The present application claims priority to (is a non-provisional of) U.S. Pat. App. No. 61/866,000 entitled "Systems and Methods for Utilizing Information to Monitor Targets", and filed Aug. 14, 2013 by Buck et al. The entirety of the aforementioned provisional patent applications is incorporated herein by reference for all purposes.

BACKGROUND OF THE INVENTION

The present invention is related to monitoring movement, and in particular to systems and methods for initializing movement monitoring.

Large numbers of individuals are currently housed in prisons. This represents a significant cost to society both in terms of housing expense and wasted productivity. To address this concern, house arrest systems have been developed for use by less violent offenders. This allows the less violent offender to be monitored outside of a traditional prison system and allows the offender an opportunity to work and interact to at least some degree in society. The same approach is applied to paroled prisoners allowing for a monitored transition between a prison atmosphere and returning to society. House arrest systems require substantial oversight and/or setup costs. Such costs can make use of house arrest systems less desirable.

Thus, for at least the aforementioned reasons, there exists a need in the art for more advanced approaches, devices and systems for location monitoring.

BRIEF SUMMARY OF THE INVENTION

The present invention is related to monitoring movement, and in particular to systems and methods for initializing movement monitoring.

Some embodiments of the present invention provide monitoring systems that include a monitor device associated with a monitor target where the monitor device is operable to transmit information indicating movement of the monitor target to a central monitoring system. The systems further include a computer and a computer readable medium. The computer readable medium includes instructions executable by the computer to: receive information from one or more databases where the information identifies at least one attribute corresponding to a location along a path traveled by the monitor target; analyze the information using an attribute of the monitor target where it is determined that the location along the path is problematic; and issuing an alert indicating the location along the path.

This summary provides only a general outline of some embodiments according to the present invention. Many other objects, features, advantages and other embodiments of the present invention will become more fully apparent from the following detailed description, the appended claims and the accompanying drawings and figures.

BRIEF DESCRIPTION OF THE DRAWINGS

A further understanding of the various embodiments of the present invention may be realized by reference to the figures which are described in remaining portions of the specification. In the figures, similar reference numerals are used throughout several drawings to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION OF THE INVENTION

Figure 1:
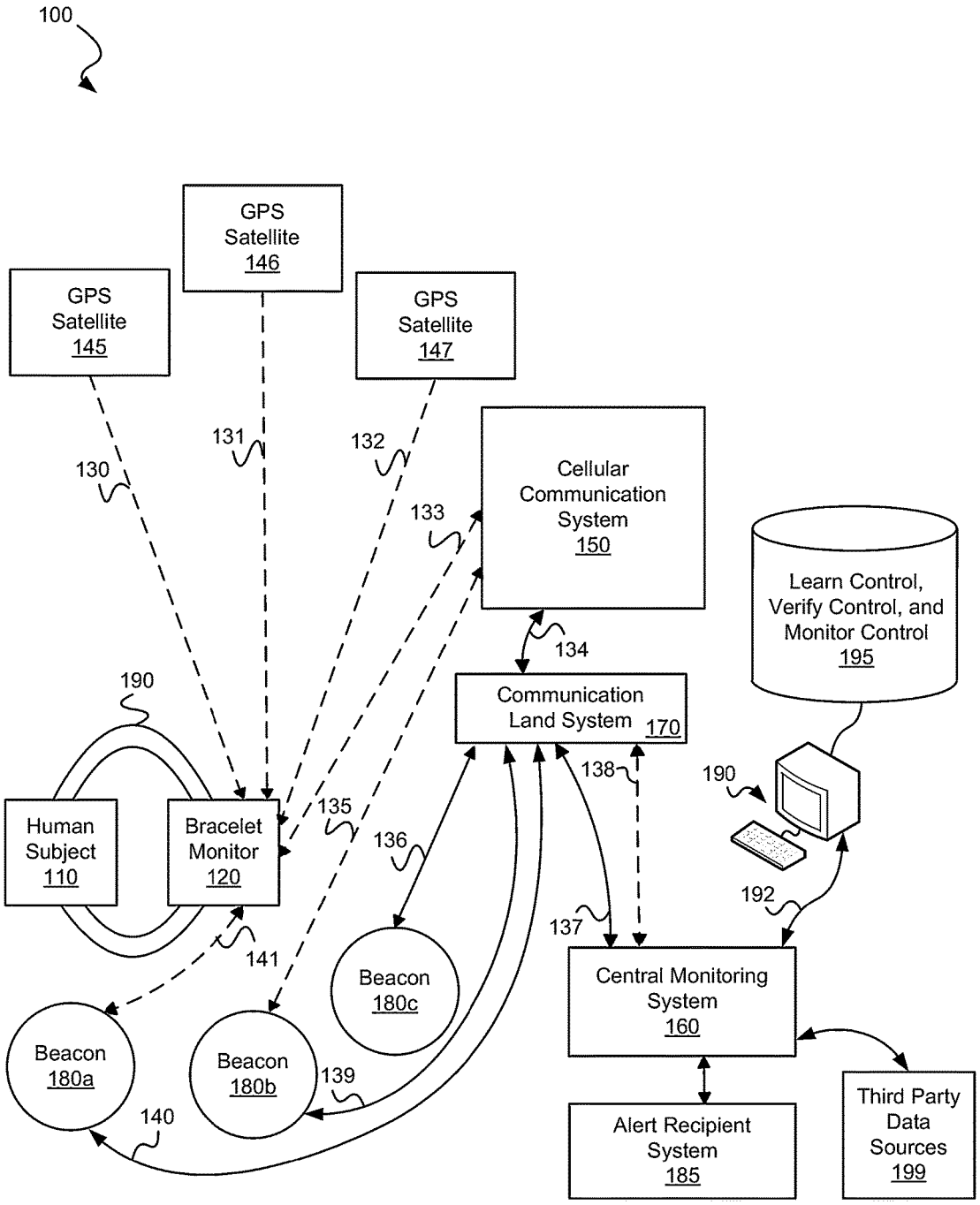
FIG. 1 is a block diagram illustrating a monitoring system in accordance with various embodiments of the present invention.

The present invention is related to monitoring movement, and in particular to systems and methods for initializing movement monitoring.

Existing asset tracking systems typically require a substantial effort on the part of an official to manually designate schedules including areas and times where/when a monitored individual is not allowed to venture. This manual process may involve the official interviewing the monitored individual to determine the monitored individual's place of residence, local shopping areas, church services, court ordered substance testing location, and place of work, as well as times when the monitored individual is expected to be at the various identified location. The official must then determine acceptable travel paths that may be used by the monitored individual to travel between the identified locations, and times when the travel paths are expected to be used. The official enters this information on a daily, semi-daily, weekly or bi-weekly basis depending upon the interview with the monitored individual. It will be appreciated that such an approach for establishing a monitoring program for a given monitored individual may involve programming hundreds or thousands of schedule entries the combination of which define exclusion areas, inclusion areas and corresponding times. Such an approach is costly and may become prohibitive.

Further, even if careful monitoring or a monitored individual occurs, an official may miss one or more problem indicators. To reduce this possibility, some embodiments of the present invention provide systems and methods for utilizing third party data sources in relation to monitoring an individual's movement. For example, some embodiments of the present invention may perform demographic analysis using data available from, for example, the US Census, Experian™ Household and Individual information, and/or the Dunn and Bradstreet™ Analytic datasets to better identify zones of interest. When a zone is found to be frequented by a monitored individual, an analysis of the area including the business types, household statistics including as income levels, education, and number of children registered in the household. Parks, schools, day care facilities, and even prison or halfway houses can be located to recognize suspicious behavior near locations with an elevated risk. Businesses of suspicion may include, but are not limited to liquor stores, bars, casinos, gun sales, pawn shops, and/or toy stores. As another example, some embodiments of the present invention utilize third party data sets indicating the location of free Wi-Fi access point locations are available for download over API. Once a location is identified as being frequented by a monitored individual, the presence of a free Wi-Fi access point at the location could identify high risk behavior that is in violation of a monitored individual's parole agreement. In yet other examples, third party mapping and traffic information available from, for example Tom Tom™. Once a route followed by a monitored individual is identified, analytics can be used to calculate the acceptable walk, bike, and drive times; including alternative routes. A monitored individual is then allotted a travel route and corresponding travel time. Where time or route violations occur, they are flagged as a possible indication that a monitored individual is attempting to use a new route that passes by a problematic area such as, for example, a park or a school. As yet another example, crime scene databases can be collected from a number of sources and compared spatially and temporally to the GPS datasets corresponding to travel of the monitored individual. The collected crime data can also be analyzed to determine areas at a higher risk of crime for monitored individuals based on the past crime scene data collected. In addition, use of such crime scene data could be used to identify potential criminal activity and/or gang associations of the monitored individual. In some cases, predictive tool sets including, but not limited to, the publicly available R Statistical library may be used to accommodate the prediction of monitored individual behavior. As a learning curve is developed, a mean expected behavior can be concluded and then variances can be better identified. As a historic library is developed, the past and present monitored individual behavior can be used to better assess future monitored individual behavior and recommended level of monitoring required for successful completion in the monitoring program.

Some embodiments of the present invention provide monitoring systems that include a monitor device associated with a monitor target where the monitor device is operable to transmit information indicating movement of the monitor target to a central monitoring system. The systems further include a computer and a computer readable medium. The computer readable medium includes instructions executable by the computer to: receive information from one or more databases where the information identifies at least one attribute corresponding to a location along a path traveled by the monitor target; analyze the information using an attribute of the monitor target where it is determined that the location along the path is problematic; and issuing an alert indicating the location along the path.

In some instances of the aforementioned embodiments, the one or more data bases includes demographic data, and wherein the information is a subset of the demographic data. In some such instances, the subset of the demographic data identifies locations frequented by children, and the attribute of the monitor target identifies the monitored target as precluded from being near children. In other instances of the aforementioned embodiments, the subset of the demographic data identifies businesses selling alcohol, and the attribute of the monitor target identifies the monitored target as precluded from consuming alcohol. In some cases, the computer readable medium further includes instructions executable by the computer to determine a delay in travel by the monitor target along the path traveled by the monitor target. In such cases, analyzing the information using an attribute of the monitor target is limited to an area around the location of the delay.

In various instances of the aforementioned embodiments, the one or more data bases includes mapping and traffic information, and the computer readable medium further includes instructions executable by the computer to: calculate an estimated time to travel the path traveled by the monitor target; compare the estimated time to travel with an actual time of travel by the monitor target where the actual time of travel exceeds the estimated time to travel by a threshold amount; and issuing an alert indicating a time violation based at least in part on the actual time of travel exceeding the estimated time to travel by the threshold amount. In some such instances, the threshold amount is programmable. In one particular instances, the threshold amount is zero.

In some instances of the aforementioned embodiments, the one or more data bases includes Internet access locations, and the information is a subset of the Internet access locations. In one or more instances of the aforementioned embodiments, the one or more data bases includes crime scene data, and the information is a subset of the crime scene data. In some cases, the systems further include an alert recipient system operable to receive the alert and to direct the alert to a device associated with an official overseeing the monitor target.

Other embodiments of the present invention provide methods for monitoring targeted movement that include receiving information from a server computer, where the information identifies at least one attribute corresponding to a location along a path traveled by a monitor target; analyzing the information using an attribute of the monitor target using a processing system, where it is determined that the location along the path is problematic; and issuing an alert indicating the location along the path. In some cases, the methods further include associating a monitor device with the monitor target. The monitor device is operable to transmit information about the monitor target to a receiving system, and the information indicates movement of the monitor target.

Turning to FIG. 1, a monitoring system 100 is depicted in accordance with various embodiments of the present invention. Monitoring system 100 may be tailored for tracking human subjects, however, it should be noted that various implementations and deployments of monitoring system 100 may be tailored for tracking non-human targets such as, for example, other animals or inanimate assets. Such inanimate assets may include, but are not limited to, automobiles, boats, equipment, shipping containers or the like. In one particular embodiment, monitoring system 100 is tailored for tracking delivery vehicles. Based upon the disclosure provided herein, one of ordinary skill in the art will recognize a variety of individuals, animals and/or assets that may be monitored in accordance with different embodiments of the present invention, and/or different monitoring scenarios or systems that may be modified to incorporate one or more features disclosed herein.

Monitoring system 100 includes, but is not limited to, a bracelet monitor 120 that is physically coupled to a human subject 110 by a securing device 190. In some cases, securing device 190 is a strap that includes a continuity sensor that when broken indicates an error or tamper condition. Further, in some cases, bracelet monitor 120 includes a proximity sensor that is able to detect when it has been moved away from an individual being monitored. When such movement away from the individual is detected, an error or tamper condition may be indicated. Based on the disclosure provided herein, one of ordinary skill in the art will recognize a variety of tamper sensors that may be incorporated in either bracelet monitor 120 or securing device 190 to allow for detection of removal of bracelet monitor 120 or other improper or unexpected meddling with bracelet monitor 120. Further, based upon the disclosure provided herein, one of ordinary skill in the art will recognize a variety of monitors and/or securing devices that may be appropriate where the target of the monitoring is not a human or other animal subject, but rather an asset.

Bracelet monitor 120 is designed to provide the location of human subject 110 under a number of conditions. For example, when bracelet monitor 120 is capable of receiving wireless GPS location information 130, 131, 132 from a sufficient number of GPS satellites 145, 146, 147 respectively, bracelet monitor 120 may use the received wireless GPS location information to calculate or otherwise determine the location of human subject 110. Alternatively or in addition, the location of a beacon 180 that is local to bracelet monitor 120 may be used as the location of bracelet monitor 120. As yet another alternative, an AFLT fix may be established based on cellular communication with bracelet monitor 120. It should be noted that other types of earth based triangulation may be used in accordance with different embodiments of the present invention. For example, other cell phone based triangulation, UHF band triangulation such as Rosum, Wimax frequency based triangulation, S-5 based triangulation based on spread spectrum 900 MHz frequency signals. Based on the disclosure provided herein, one of ordinary skill in the art will recognize other types of earth based triangulation that may be used.

As yet another alternative, an AFLT fix may be established based on cellular communications between bracelet monitor 120 and a cellular communication system 250. Furthermore, when wireless communication link 233 between bracelet monitor 120 and cellular communications system 250 is periodically established, at those times, bracelet monitor 120 may report status and other stored records including location fixes to a central monitoring system 260 via wireless communication link 238.

Monitoring system 100 includes, but is not limited to, at least one beacon 180. Beacons 180 are instrumental for beacon based monitoring systems. Within FIG. 1, a telemetric wireless link 141 has been depicted between beacon 180*a* and bracelet monitor 120. Each beacon 180 has an adjustable range to make telemetric wireless contact with bracelet monitor 120. At any point in time, depending on each beacon's 180 relative distance to bracelet monitor 120, none, one, or more than one tracking beacons 180 may be within transmission range of a single bracelet monitor 120. Likewise, it is further conceivable under various circumstances that more than one bracelet monitor 120 at times be within in range of a solitary beacon 180.

Telemetric wireless communications path 141 established at times between tracking beacon 180*a* and bracelet monitor 120 illustrates a common feature of various different embodiments of the current invention. Some embodiments of the various inventions vary on how, i.e. protocol, and what information and/or signaling is passed over wireless link 141. For example, in more simplified configurations and embodiments, each beacon 180 is limited to repetitively transmitting its own beacon ID and physical location information. In that way, once bracelet monitor 120 is within transmission range of tracking beacon 180*a* and establishes wireless or wired reception 141, then bracelet monitor 120 can record and store received beacon ID and location information. At a later time, for some embodiments of the present invention, bracelet monitor 120 can then report recorded readings from beacons 180 to the central monitoring system 160 over the cellular communication system 150 using wireless links 133 and 138 as depicted in FIG. 1. Furthermore, many embodiments allow for such transmissions and information passing to occur without being noticed by human subject 110, and unnoticed, automatically, and near effortlessly central monitoring system 160 is able to establish records and track human subject's 110 movements and whereabouts.

In other embodiments or configurations according to the present invention, each beacon 180 also transmit status information related to its own device health and information related from each beacon's 180 internal tampering, movement, or other sensors via a communication system 170 to central monitoring system 160. This allows for detection of movement of beacons 180, and establishing some level of confidence that the location reported by each of beacons 180 is accurate. Various other details about a beacon based system are disclosed in U.S. patent application Ser. No. 12/041,746 entitled "Beacon Based Tracking Devices and Methods for Using Such" and filed Mar. 4, 2008 by Buck et al. The entirety of the aforementioned reference is incorporated herein by reference for all purposes.

Likewise, in some other embodiments, each bracelet monitor 120 contains a host of their own tampering, shielding, movement, and/or other sensors related to its own device health. While still further embodiments also include a host of other measurement transducers within bracelet monitor 120 for extracting information, and for later reporting, related to physical properties of human subject 110. For example, measuring for the presence of alcohol and/or other drugs present in human subject 110 may be included in some embodiments of bracelet monitor 120. As one example, the alcohol sensor discussed in U.S. patent application Ser. No. 12/041,765 entitled "Transdermal Portable Alcohol Monitor and Methods for Using Such" and filed by Cooper et al. on Mar. 4, 2008. The entirety of the aforementioned reference is incorporated herein by reference for all purposes.

Beacons 180 in alternative embodiments of the present invention may communicate with central monitoring system 160 independently of bracelet monitor 120. The monitoring system 100 illustrated in FIG. 1 shows beacon 180*b* having both a wireless communication link 135 with cellular communication system 150, and also illustrates beacon 180*b* having a hardwired communication link 139 with land communication system 170. Monitoring system 100 is also shown with beacons 180*a*, 180*b*, and 180*c* each having hardwired land communication links 140, 139, and 136 respectively to land communication system 170. Monitoring system 100 further illustrates land communication system 170 having a hardwired communication link 134 to cellular communication system 150, and a hardwired communication link 137 to central monitoring system 160.

In some embodiments of the present invention, beacons 180 are located in areas frequented by human subject 110 where bracelet monitor 120 is incapable of accessing information from the GPS system. Such beacons eliminate the need to perform an AFLT fix and avoid the costs associated therewith. As an example, human subject 110 may have a tracking beacon 180 placed within his home, and one also placed at his place of employment in close proximity to his work area. In this way, the two placed beacons, each at different prescribed times, can interact with his attached bracelet monitor 120 to periodically make reports to central monitoring system 260 to track movements and the whereabouts of human subject 110. All this can be done without incurring the costs associated with performing an AFLT fix.

Monitoring system 100 further includes a control station 191 that is communicably coupled to central monitoring system 160 via a communication link 192. In one particular embodiment of the present invention, control station 191 is a personal computer including a display device, a processor, and/or one or more I/O devices. Based upon the disclosure provided herein, one of ordinary skill in the art will recognize a variety of systems that may be used as control station 191. A storage medium 195 is communicably coupled to control station 191 and maintains instructions governing the operation of a learn control mode, a verify control mode, and a monitor control mode.

Central monitoring system 160 includes functionality for sending alerts to an alert recipient system 185 when a tracked individual or asset violates one or more time and location rules developed using the aforementioned learn control and verify control (e.g., when a monitor target ventures into an exclusion zone a defined distance or for a defined period of time). In some cases, the learned path is statistically adjusted to be a mean location traversed over a number or times, and an expected variance. When a location of the monitored individual exceeds the variance from the mean, an alert may be generated. Various implementations of the learn control mode, verify control mode and monitor control mode are more fully described below in relation to FIGS. 2-14. Such an alert recipient system 185 may be, but is not limited to, a law enforcement computer deployed at a dispatch station of the law enforcement facility or a hand held computer maintained by a law enforcement official. Based upon the disclosure provided herein, one of ordinary skill in the art will recognize a variety of alert recipient systems 185 that may be used in relation to one or more of the embodiments discussed herein.

Central monitoring system 160 has access to one or more third party data sources 199. These third party data sources may include, but are not limited to, demogramphic databases, databases indicating the location of publicly available Internet access points, mapping and traffic information, and/or crime scene databases. Use of information from these databases allows for checking a learned path against potential problems.

Demographic databases may include, but are not limited to, government census information, Experian™ household and individual information, and/or Dunn and Bradstreet™ Analytics database. Based upon the disclosure provided herein, one of ordinary skill in the art will recognize a variety of other databases or data sources that may be used in relation to different embodiments of the present invention. As an example, using demographic databases, a learned path of a convicted burglar may be compared against high income areas, or a learned path of a convicted child abuser may be checked against locations known to be frequented by children, or a learned path of an alcoholic may be checked against locations of bars or liquor stores. Based upon the disclosure provided herein, one of ordinary skill in the art will recognize a variety of other uses for demographic information. Alternatively, or in a addition, the demographic information may be used to determine any potential problems at an area along the learned path where a monitored individual is stopping or slowing more than expected.

Mapping and traffic information may be that available from providers such as Tom Tom™ or other providers, and provides an ability to obtain an objective estimate of time that it takes to travel the learned path. This information can be used to determine whether the monitoring individual is traveling too slowly along the path in an effort to get more uncontrolled time. This may be used during the leaning phase to warn a monitoring officer against accepting the learned path, or may be used during a monitoring mode to determine whether the monitored individual may be taking too much time along the travel route. As the mapping and traffic information takes traffic into account, the excuse of being caught in traffic is effectively removed.

Databases indicating the location of publicly available Internet access points may be compared against delays in movement of the monitored individual. For example, where it is determined that a monitored individual consistently stops at a particular location while traveling along the learned path. This stopping location may be compared against locations of known Internet access (e.g., WiFi hotspots). Where Internet access is available, an official can be alerted of the availability.

Crime scene information may be available from law enforcement or others. Such crime scene data can be compared spatially and temporally to the locations of a monitored individual. This comparison may be used to assure that the monitored individual is not traveling along a learned path through a high risk crime area. Alternatively, or in addition, this comparison may be used to determine whether the monitored individual has gang associations where the individual typically chooses to travel through known gang areas.

Figure 2:
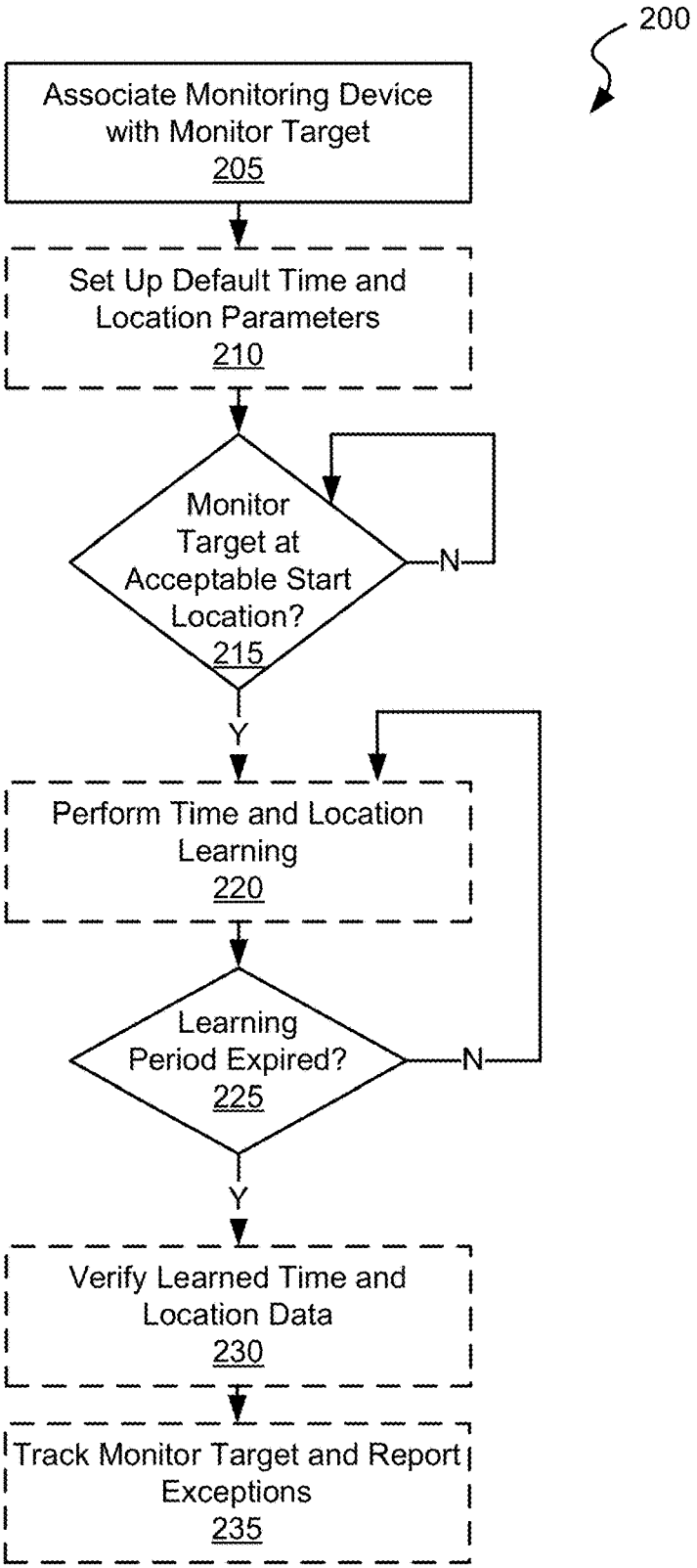
FIG. 2 is a flow diagram depicting an operational mode for initializing and operating a monitoring system in accordance with various embodiments of the present invention.

Turning to FIG. 2, a flow diagram 200 depicts an operational mode for initializing and operating a monitoring system in accordance with various embodiments of the present invention. Following flow diagram 200, a monitor device is associated with a monitor target (block 205). Where the monitor target is a human subject, associating the monitor device with the monitor target may include placing the monitor device in a pouch maintained by the human subject or physically attaching the monitoring device to the human subject using, for example, a strap or bracelet. Alternatively, where the monitor target is a non-human asset, associating the monitor device with the monitor target may include placing the monitor device inside the asset or otherwise attaching the monitor device to the asset. Based upon the disclosure provided herein, one of ordinary skill in the art will appreciate a variety of ways that a monitor device may be associated with an asset.

Various default time and location parameters and other defaults parameters may be associated with the monitor target (block 210). As an example, where the monitor target is an automobile, a default parameter may be set up to exclude any out of state travel between Friday at midnight and Sunday at midnight. As another example, where the monitor target is a delivery vehicle, a default parameter may be set up to exclude any travel more than five miles outside of an expected delivery region. As yet another example, where the monitor target is an alcoholic, a default parameter may be set up to exclude travel in bar or entertainment areas and/or beyond defined geographic limits such as state or county lines. As yet a further example, where the monitor target is a sex offender, a default parameter may be set up to exclude travel near schools or near the known location of the offender's victims, and/or beyond defined geographic limits such as state or county lines. Based upon the disclosure provided herein, one of ordinary skill in the art will recognize a variety of default time and location parameters that may be associated with the monitor target. In some cases, a default location may not be time limited such that is does not allow excursion into the location any time twenty-four hours a day, seven days a week. For example, an alcoholic may always be excluded from traveling in an area that includes a number of bars. In other cases, the default location may be time limited. For example, an individual under house arrest may be allowed to travel to a house of worship between particular hours and on particular days for attendance at a worship service, but will not be allowed to travel to the house of worship at any other time. Setting up such default parameters may include categorizing the monitor target (e.g., a sex offender, an alcoholic, a delivery vehicle, or the like), and selecting a group of pre-determined default parameters that may be applied to the determined category of monitor target (e.g., not near schools and not beyond city limits). Various implementations of associating default time and location parameters with the monitor target are discussed below in relation to FIGS. 3-4.

In some cases, the default location and time parameters may be entered by selecting a central or home base for the monitored target, selecting the size of an outer perimeter for the monitor target (this may include selecting the size and/or shape of the outer exclusion zone), selecting a category for the monitor target (e.g., delivery vehicle, sex offender, substance abuser, or the like) and allowing the system to automatically program an initial set of fixed exclusion zones based upon the abstractly selected default location and time parameters.

In addition to the default time and location parameters, the official may also program a grace period for arrival at particular points in an inclusion zone or leaving early in case there are clock synchronization issues. The official may also program the size of any buffer around a learned or interim inclusion zone to allow for the potential of alternative routes in case of traffic or other issues. Yet further, the official can program the time the monitor target must remain at a location in the learn phase before an end point of start point of a learned path is established. Additionally, the official could select a period of time sufficient to allow a monitor target to be present within an expected zone of operation before a learning mode is started (i.e., a period used to trigger block 215 of flow diagram 200). Substantial time may be allowed where there is a possibility that traffic or other factors may slow the return to the expected area. An official may also program a threshold for alerts or sending exceptions when the monitoring mode is operated (e.g., block 235 of flow diagram 200). This would assure that a single step into an exclusion zone would not trigger an alert as the threshold may require a defined amount of time or number of points within an exclusion zone to be generated before an alert or exception is reported. In addition, the official may program an amount of time during which the learn operation (e.g., block 220 of flow diagram 200) is performed. This programmable time period would control the decision of block 225 of flow diagram 200. This period may be one week where the schedule of the monitor target is expected to be regular, or for several weeks where the schedule is highly variable (e.g., an individual working swing shifts some weeks and days other weeks).

It is then determined whether the monitor target is at an acceptable location to begin the learning process (block 215). For example, where the monitor target is a human subject, it is determined whether the human subject is at home or within an area that would be expected to be frequented by the human subject. This assures that paths outside of the expected area to be frequented by the monitor target are not recorded while the human subject is returning to the area. This determination may be made, for example, by the human subject calling the official setting up the monitor system to notify of their location. Alternatively, the determination may be made, for example, by allowing a determined amount of time for the human subject to walk home. This predetermined amount of time may be set up during the aforementioned block 210. Based upon the disclosure provided herein, one of ordinary skill in the art will recognize a variety of approaches for determining that a monitor target is likely at an acceptable start location that may be used in relation to different embodiments of the present invention.

Time and location learning is then performed (block 220). In FIG. 1, this time and learning process is referred to as a learn control mode. During performance of time and location learning, the travels of the monitored target are monitored and a database of the travels is maintained. The travels of the monitor target are tracked by receiving location information from the monitoring device associated with the monitor target. As discussed above in relation to FIG. 1, the location information available from the monitoring device may be GPS information, beacon based information, or any other information capable of identifying the location of the monitor target. The location information includes time stamp information making it possible to determine the location of monitor target at specific times during a week or other period. The paths established during the learning process are referred to as interim inclusion zones as they are presumptively expected to be included in the range of locations and times that the monitor target will be expected to operate once the learning process is completed.

During the learning control mode, the travels of the monitored target are watched to assure that they do not extend into any fixed exclusion zone corresponding to the default time and location parameters established in block 210. As used herein, the phrase "fixed exclusion zone" is used in its broadest sense to mean a location defined prior to the learning control mode where a monitor target is not permitted to venture. In some cases, the fixed exclusion zones are non-time limited, while in other cases they are time limited. A monitor target is allowed to venture into a time limited exclusion zone during particular periods of time. For example, a monitor target may be allowed to enter a time limited exclusion zone during the hours when bars are closed, but not during other times. In contrast, a monitor target is never permitted to venture into a non-time limited exclusion zone. For example, where the monitor target is a delivery vehicle and the default time and location parameters exclude travel on a weekend, the location of the monitor target may be immediately reported to a monitoring entity or monitoring official if any movement is recorded on a weekend. Alternatively, where the monitored target is a sex offender and the default time and location parameters exclude travel near schools, the location of the monitor target may be immediately reported to law enforcement if the monitor target ventures near a school. The learning process continues for a defined period of time such as, for example, one or two weeks (block 225). This time period may be programmed as part of setting the default parameters in block 210.

Once the learning period has expired (block 225), the learned time and location data established during the learning process are verified (block 230) to establish a final set of exclusion zones including both fixed exclusion zones corresponding to the default time and location parameters established in block 210 and modifiable exclusion zones. As used herein, the phrase "modifiable exclusion zone" is used in its broadest sense to mean a location where a monitor target is not permitted to venture that is not a fixed exclusion zone. Thus, a combination of all modifiable exclusion zones and fixed exclusion zones defines all locations where a monitor target is not permitted to travel. In some cases, the modifiable exclusion zones are non-time limited, while in other cases they are time limited. Again, a monitor target is allowed to venture into a time limited modifiable exclusion zone during particular periods of time. For example, a monitor target may be allowed to enter a time limited modifiable exclusion zone during the hours of a worship service, but not during other times. In contrast, a monitor target is never permitted to venture into a non-time limited modifiable exclusion zone.

During the verification process (block 230), the interim inclusion zones are displayed to an official that determines whether a given interim inclusion zone is to be accepted as is, modified, or rejected. In FIG. 1, this verification process is referred to as a verify control mode. For example, where the monitor target is an individual and the interim inclusion zone passes from the individual's residence to his place of work during an acceptable window of time, the interim inclusion zone may be accepted as is. Alternatively, where the monitor target is an individual and the interim inclusion zone passes from the individual's residence to his place of work between the time of 8:20 am and 9:10 am, the interim inclusion zone may be modified by increasing the window of time during which the inclusion zone may be used to, for example all hours between 5:00 am and 10:00 pm five days a week. As another example, where the monitor target is an individual and the interim inclusion zone passes from the individual's residence to his place of work, the interim inclusion zone may be modified by increasing the area of the interim inclusion zone to allow for significant variance in the path the individual may travel from their residence to work. This would allow for taking a different path where traffic is a problem. Where, in contrast, the interim inclusion zone travels too close to a prohibited boundary or goes to a location that is not essential or otherwise not desired, the interim inclusion zone may be rejected. The accepted and modified interim inclusion zones are referred to herein as accepted inclusion zones.

Once all of the interim inclusion zones have been verified, an updated set of fixed exclusion zones and modifiable exclusion zones are established. This is done by including all of the fixed exclusion zones in a database of exclusion zones associated with the monitor target, and then by defining all remaining areas that are not identified as accepted inclusion zones as modifiable exclusion zones. These modifiable exclusion zones are included in the database of exclusion zones along with the fixed exclusion zones. As an example, where the accepted inclusion zones do not proceed into particular regions, the region is identified as a modifiable exclusion zone that is not time limited. As another example, where the accepted exclusion zone is limited to the hours between 8:00 am and 5:00 pm, the region is identified as a modifiable exclusion zone that is time limited to the hours between 5:00 pm and 8:00 am. As such, the database of exclusion zones identifies all of the locations and/or combination of locations and times where a monitor target is prohibited from traveling. Again, each of the exclusion zones may be time limited or non-time limited.

Such an approach avoids the need for an official to guess the exact paths that will be needed by a monitor target and then to program all of the allowed paths, and/or for the official to spend considerable time and effort setting up the exclusion zones. Rather, the monitor target is allowed to demonstrate expected paths during a learning control mode, and the official merely needs to edit the demonstrated paths to yield a final set of exclusion zones during a verify control mode where the monitor target is permitted to travel. Again, the exclusion zones may be either time limited or non-time limited.

Once the verification process is completed (block 230), the monitor target is tracked (block 235). Where the monitor target moves into an exclusion zone, an alert or exception may be generated and sent to an alert recipient system. For example, where the monitor target is a delivery vehicle that is not allowed to move more than twenty miles from a home office between Monday at 5:00 am and Friday at 10:00 pm, and is not allowed to move away from the home office between Friday at 10:00 pm and Monday at 5:00 am, an exception or alert will be issued if either of the aforementioned rules are violated. As another example, where the monitor target is an individual that is never permitted to be within a defined distance of a school, outside of their residence between the hours of 10:00 pm and 5:00 am, or on a path encompassing a church outside of the hours of 10:00 am and 1:00 pm on Sunday, an exception or alert will be issued if either of the aforementioned rules are violated. Based upon the disclosure provided herein, one of ordinary skill in the art will recognize a variety of other exclusion zones (both time limited and non-time limited) that may be monitored with exceptions being reported where the monitor target violates the exclusion zones.

Figure 3A:
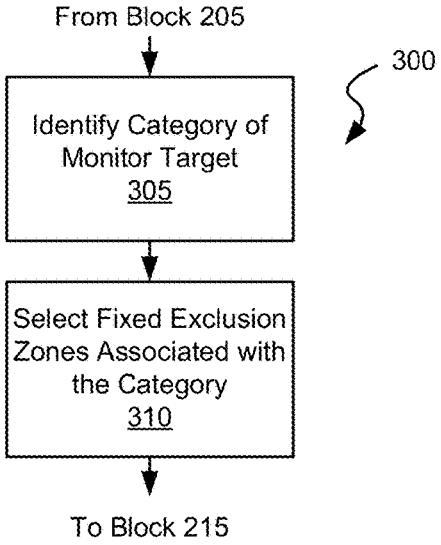
FIGS. 3*a*-3*b* are flow diagrams depicting operational modes of a monitoring system incorporating fixed exclusion zones in accordance with one or more embodiments of the present invention.

Turning to FIG. 3*a*, a flow diagram 300 depicts an operational mode of a monitoring system incorporating fixed exclusion zones in accordance with one or more embodiments of the present invention. In some cases, flow diagram 300 may be used in place of block 210 discussed above.

Following flow diagram 300, a monitor target is categorized (block 305) and one or more fixed exclusion zones associated with the identified category are associated with the monitor target (block 310). The fixed exclusion zones may be easily programmed by an official though selection of a central or home base for the monitored target, selecting the size of an outer perimeter for the monitor target (this may include selecting the size and/or shape of the outer exclusion zone), selecting a category for the monitor target (e.g., delivery vehicle, sex offender, substance abuser, or the like) and allowing the system to automatically program an initial set of fixed exclusion zones. The official could also program a grace period for arrival at particular points in an inclusion zone or leaving early in case there are clock synchronization issues. The official may also program the size of any buffer around a learned or interim inclusion zone to allow for the potential of alternative routes in case of traffic or other issues. Yet further, the official can program the time the monitor target must remain at a location in the learn phase before a zone would be enacted (i.e., a period used to trigger block 215 of flow diagram 200). Such a period would allow a monitor target to be within an expected region of operation before the learning process is started. Substantial time may be allowed where there is a possibility that traffic or other factors may slow the return to the expected area. An official may also program a threshold for alerts or sending exceptions when the monitoring mode is operated (e.g., block 235 of flow diagram 200). This would assure that a single step into an exclusion zone would not trigger an alert as the threshold may require a defined amount of time or number of points within an exclusion zone to be generated before an alert or exception is reported. In addition, the official may program an amount of time during which the learn operation (e.g., block 220 of flow diagram 200) is performed. This programmable time period would control the decision of block 225 of flow diagram 200. This period may be one week where the schedule of the monitor target is expected to be regular, or for several weeks where the schedule is highly variable (e.g., an individual working swing shifts some weeks and days other weeks).

Figure 4A:
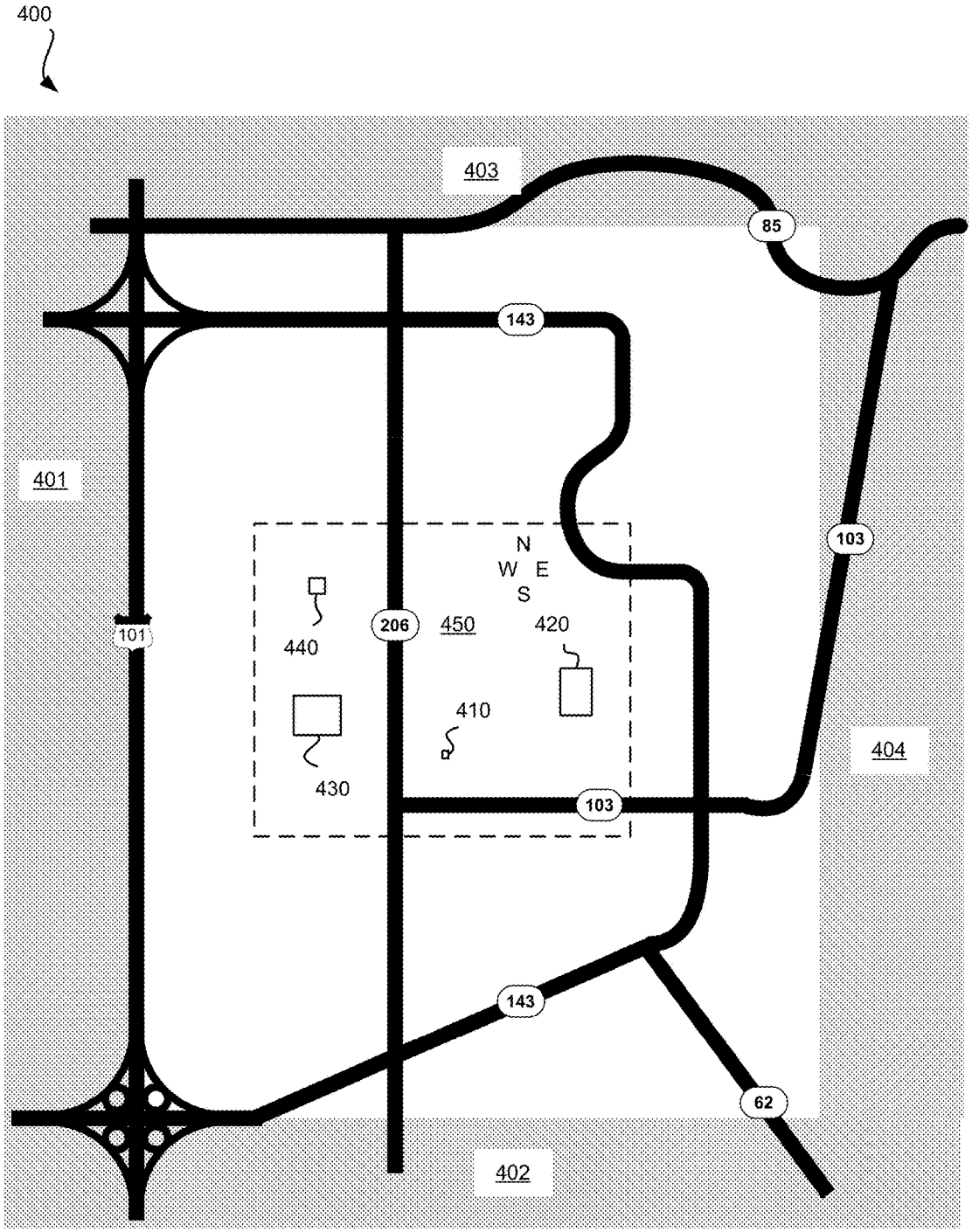
FIGS. 4*a*-4*b* are exemplary displays including fixed exclusion zones in accordance with one or more embodiments of the present invention.
Figure 4B:
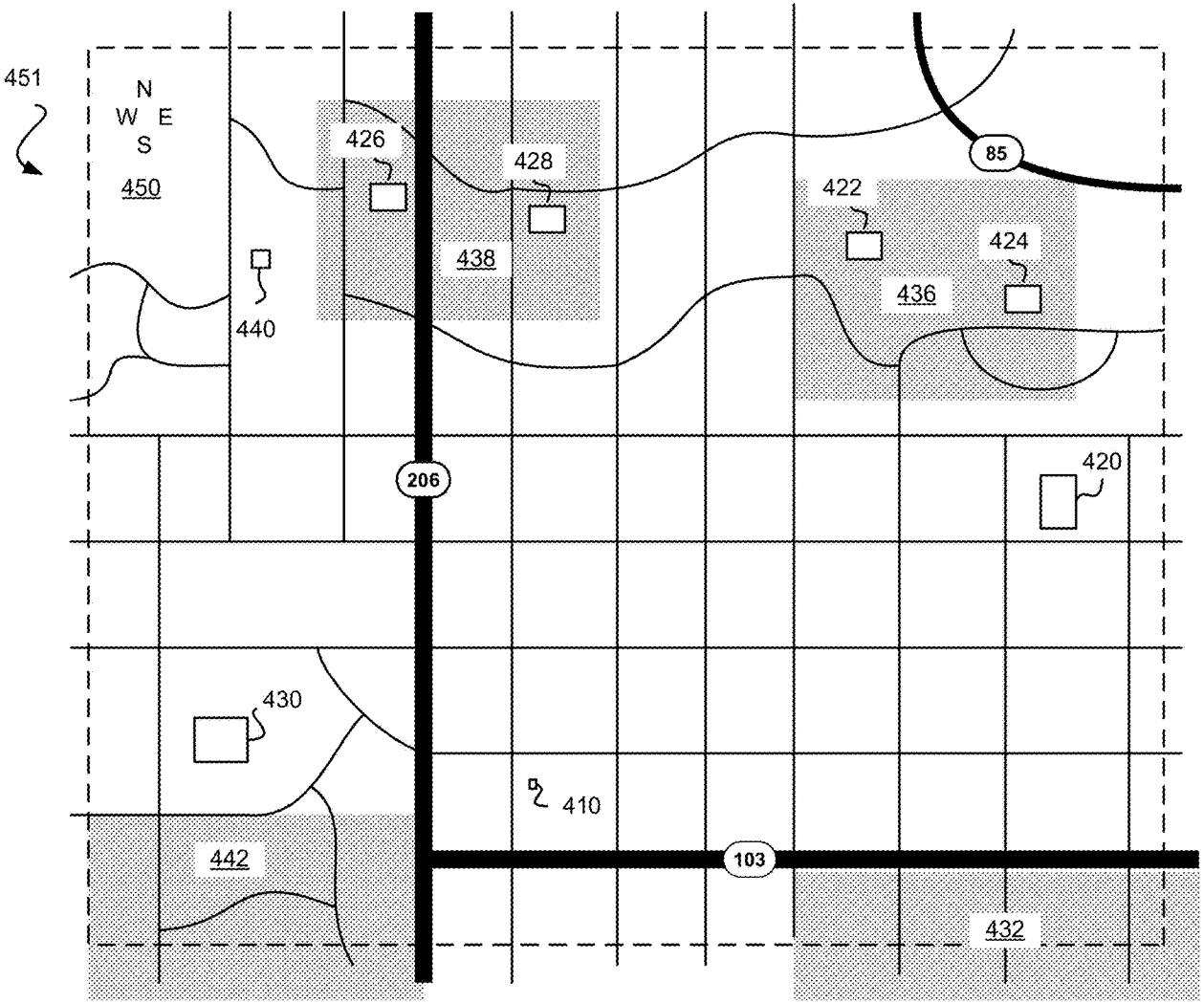

As an example, the monitor target may be categorized as a delivery vehicle of a particular company. Where the company never takes delivery vehicles outside of a particular radius from the home office, fixed exclusion zones may be placed for any locations beyond the radius at all times. As another example, the monitor target may be identified as an individual with a history of substance abuse and child abuse. In such a case, fixed exclusion zones may be established around schools during all hours, around areas of known drug trafficking during all hours, around areas with a high density of bars during hours when the bars are open, and around an outer perimeter surrounding the individual's residence. FIG. 4*a* shows an exemplary display 400 including a number of fixed exclusion zones 401, 402, 403, 404 (depicted as patterned regions with a pattern of 45 degree lines moving from left to right) defining an outer boundary beyond which the individual will not be allowed to travel. Display 400 may be displayed on a computer monitor such as the monitor of control station 191 of FIG. 1. Based upon the disclosure provided herein, one of ordinary skill in the art will recognize a variety of equipment that may be used to show display 400. Display 400 also includes a central region 450 that is shown in greater detail in FIG. 4*b*. Turning to FIG. 4*b*, central region 450 is shown including a residence 410 in relation to a shopping area 430, a church 440, a place of work 420, and schools 422, 424, 426, 428, 436. Schools 422, 424 are surrounded by a fixed exclusion zone depicted as patterned region 436 and schools 426, 428 are surrounded by a fixed exclusion zone depicted as patterned region 438. A patterned region 432 indicates an area of known drug activity, and a patterned region 442 indicates an area with a high density of bars. These exclusion zones (e.g., zones 401, 402, 403, 404, 432, 436, 438, 442) may be pre-programmed and selectable for inclusion based upon general characteristics (i.e., a category) of the monitor target. Programming such fixed exclusion zones may be relatively simple for an official requiring only the categorization of the monitor target and selection of groups of exclusion zones corresponding to the categorization.

Figure 3B:
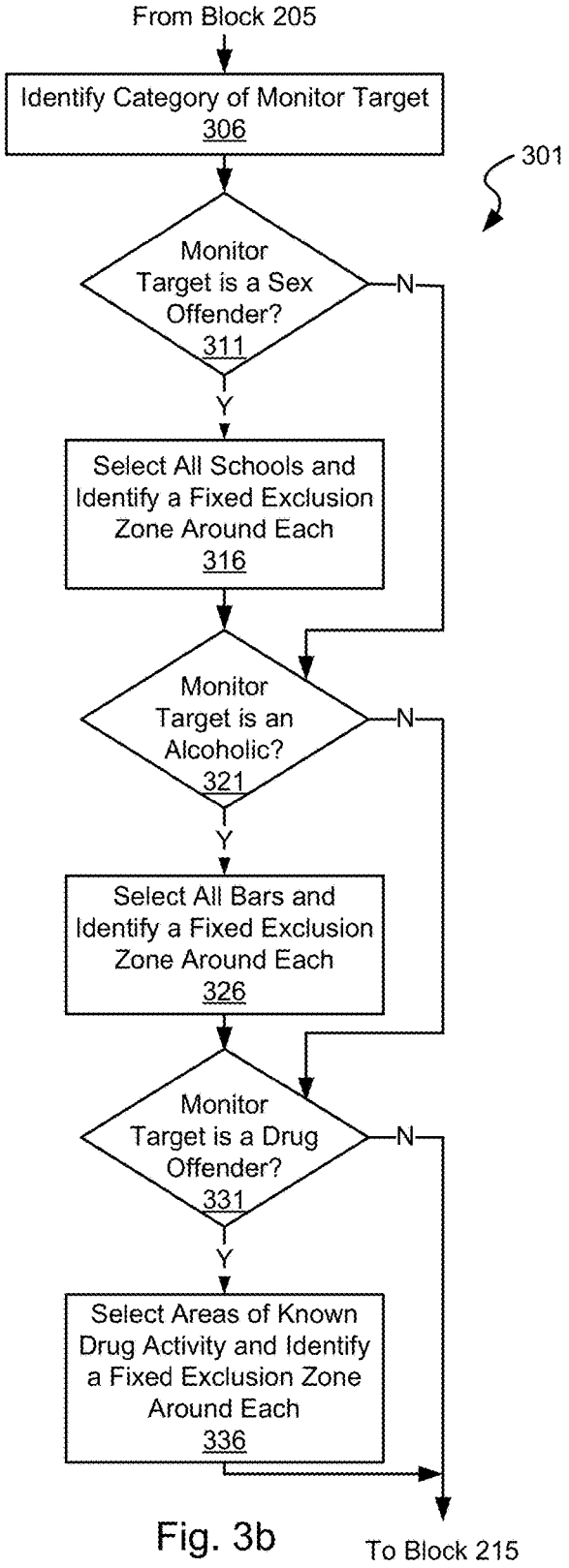

Turning to FIG. 3*b*, a more particular flow diagram 301 depicts another operational mode of a monitoring system incorporating fixed exclusion zones related to the monitoring of parolees in accordance with one or more embodiments of the present invention. In some cases, flow diagram 301 may be used in place of block 210 discussed above. Following flow diagram 301, a monitor target is categorized (block 306). It is then determined whether the category of the monitor target includes the sex offender category (block 311). Where the category of the monitor target does include a sex offender category (block 311), all schools and surrounding areas are selected as fixed exclusion zones (block 316). It is then determined whether the category of the monitor target includes alcoholic (block 321). Where the category of the monitor target does include an alcoholic category (block 321), all bars and surrounding areas are selected as fixed exclusion zones (block 326). It is then determined whether the category of the monitor target includes drug offender (block 331). Where the category of the monitor target does include an drug offender (block 331), areas of known drug activity are selected as fixed exclusion zones (block 336). As an example, this may result in displays similar display 400 and display 451 where exclusion zones are represented around the various selected category areas.

Figure 5:
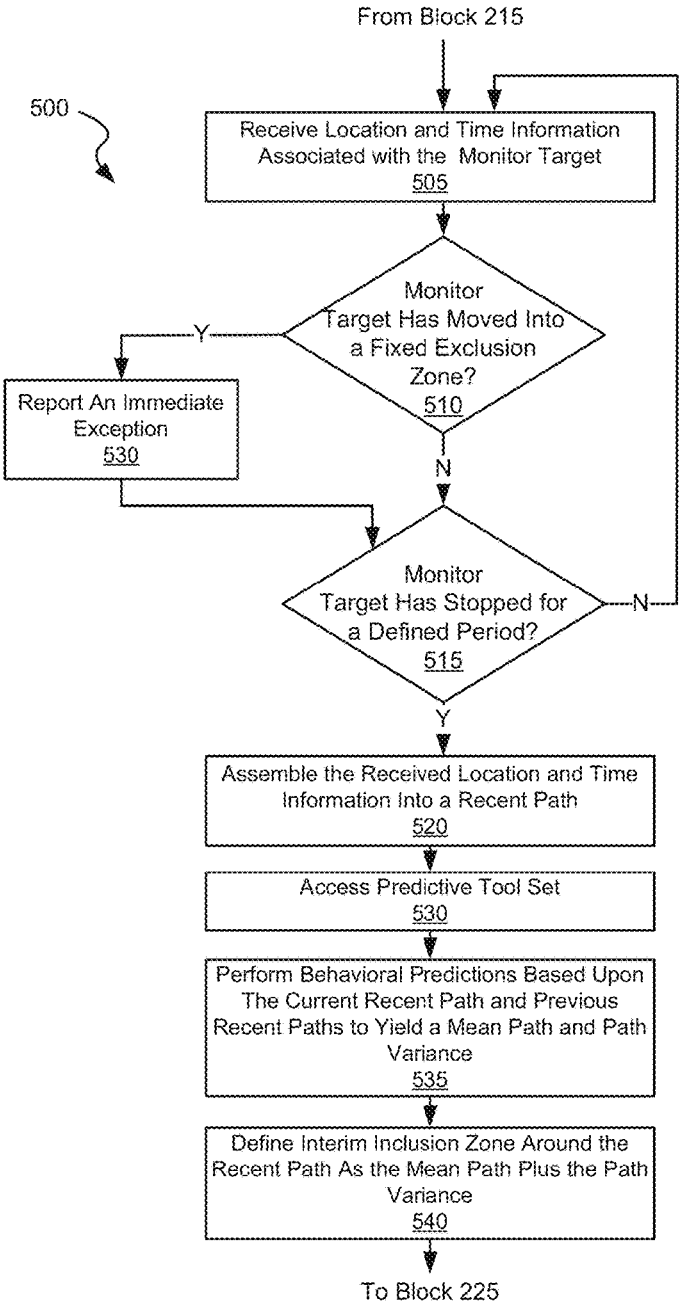
FIG. 5 is a flow diagram depicting an operational mode in accordance with some embodiments of the present invention for performing a learn control mode using monitored information and statistical analysis.

Turning to FIG. 5, a flow diagram 500 depicts an operational mode in accordance with some embodiments of the present invention for performing a learn control mode using monitored information. In some cases, flow diagram 500 may be used to implement the learning process of block 220 discussed above. Following flow diagram 500, a continuous flow of location and time information is received that is associated with a particular monitor target (block 505). This location and time information may be received at a central monitoring location from a monitor device associated with the monitor target. As an example, where the monitor target is a human, the monitor device may be a monitor bracelet, and the central monitoring location may be the central monitoring system similar to those discussed above in relation to FIG. 1. Based upon the disclosure provided herein, one of ordinary skill in the art will recognize a variety of approaches and devices that may be used to receive location and time information about a monitor target.

As location and time information is received and updated (block 505), it is determined whether the monitor target has ventured into a fixed exclusion zone such as those defined in block 210 or discussed in relation to FIGS. 3-4 (block 510). Where a monitor target has ventured into a fixed exclusion zone (block 510), an exception or alert is generated and reported (block 530). As discussed above in relation to FIG. 3*a*, a default parameter may be defined requiring that travel inside of an exclusion zone continue for a certain distance or defined time before an exception or alert is reported to an alert recipient system. This default parameter is applied here in the decision process of block 510.

Once the exception or alert is reported (block 530) or where the monitor target is not within a fixed exclusion zone (block 510), it is determined whether the monitor target has stopped moving for a defined period of time (block 515). The gathered location and time information is to be assembled into a path that is defined as the travel of a monitor target occurring between a start point and an end point. The start point and end point are indicated by a defined period of non-movement or limited movement. Thus, for example, a path may cover an individual's travels between home and work with the start point being indicated by the movement of the individual being limited to one hundred feet of his home for at least on half of an hour, and the end point being indicated by the movement of the individual being limited to one hundred feet of his place of work. The defined period and radius of movement may be programmed as part of the default parameters of block 210. Where the monitor target has not stopped moving for the defined period of time (block 515), the process of receiving location and time information (block 505) and determining whether the monitor target is staying out of fixed exclusion zones (blocks 510, 530) is continued.

Alternatively, once the monitor target has stopped for the defined period of time (block 515), the previously gathered location and time information is assembled into a recent path (block 520). An example of such a recent path 611 (depicted as a dashed line) is shown in an exemplary display of FIG. 6*a* outlining movement of a monitor target from residence 410 (i.e., a starting point) to shopping center 430 (i.e., an ending point). A start point is recorded at residence 410 and an end point is recorded at shopping center 430. Of note, once the monitor target begins moving again, shopping center 430 will be the start point for a subsequent recent path.

A predictive tool set is accessed (block 530). The predictive tool set may be, for example, able to assemble an overall travel path based upon a number of recent paths based upon concatenating a number of recent paths and calculating a mean of the recent paths and a variance of the recent paths (block 535). For example, where a first recent path is generated that extends from a beginning point to a first interim point, a second recent path is generated that extends from the first interim point to a second interim point, and a third recent path is generated from the second interim point to an ending point. In this situation, the three recent paths are concatenated to yield an overall path from the starting point to the final point. Then, other overall paths from earlier time periods extending from the starting point to the ending point are averaged together to yield a mean overall path and a variance. This may be done over several instances of the recent paths to increase the accuracy of the mean and the variance. In some cases, the learning process may be done of the course of a month or more to obtain a number of recent paths sufficient to provide a reasonable idea of where a monitored target is moving.

Figure 6A:
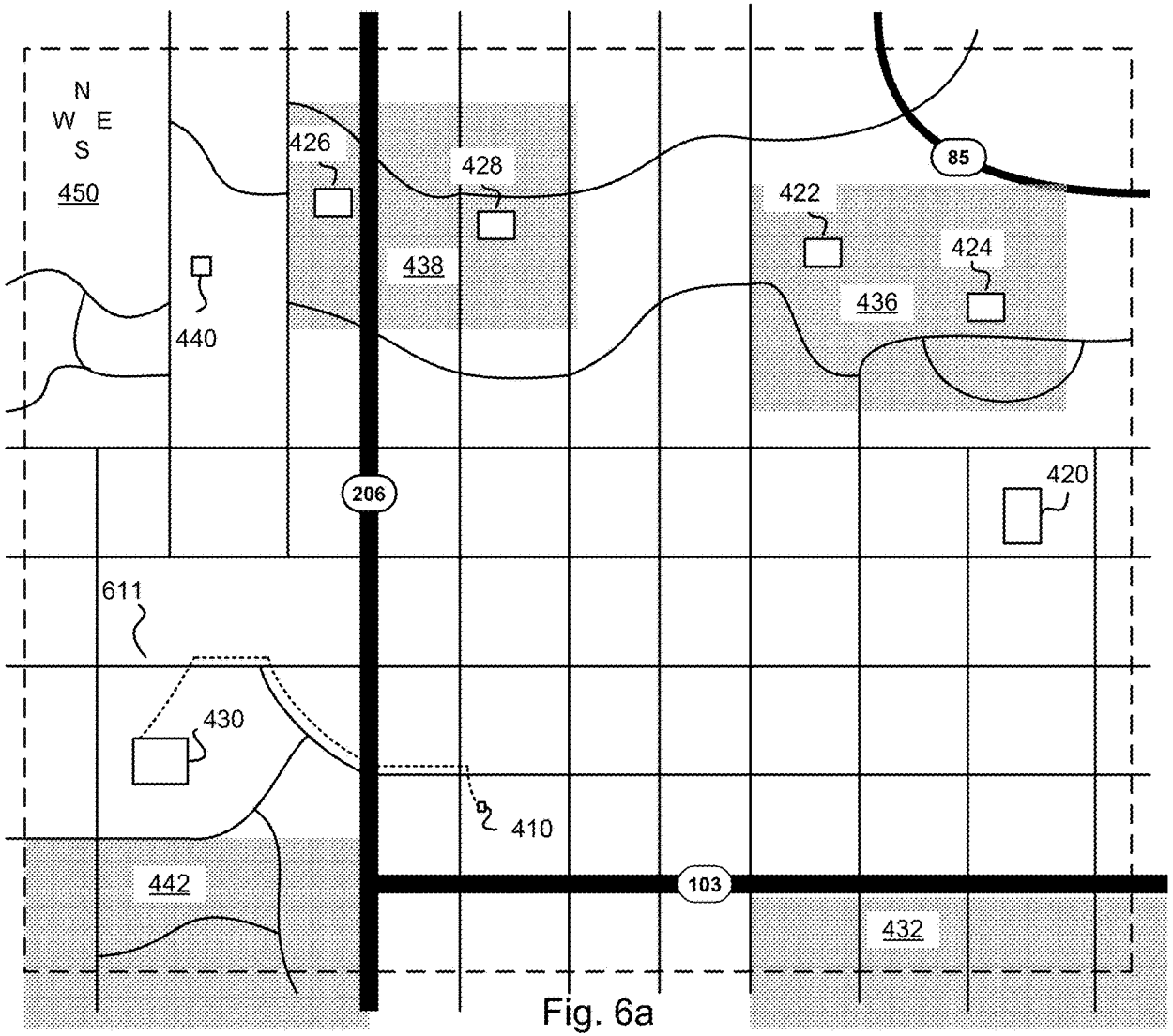
FIGS. 6*a*-6*c* are exemplary displays showing interim inclusion zones in accordance with some embodiments of the present invention.
Figure 6B:
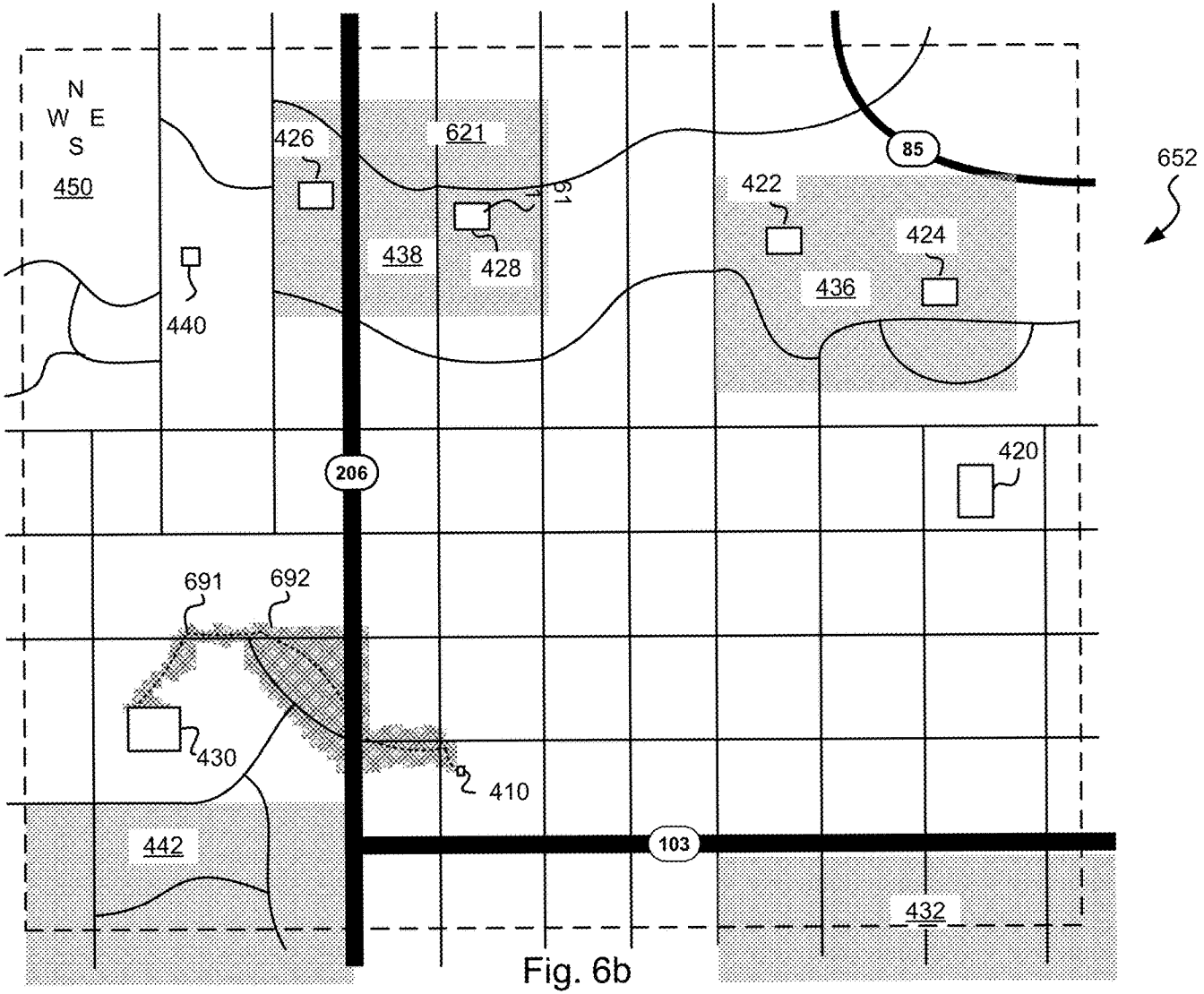
Figure 6C:
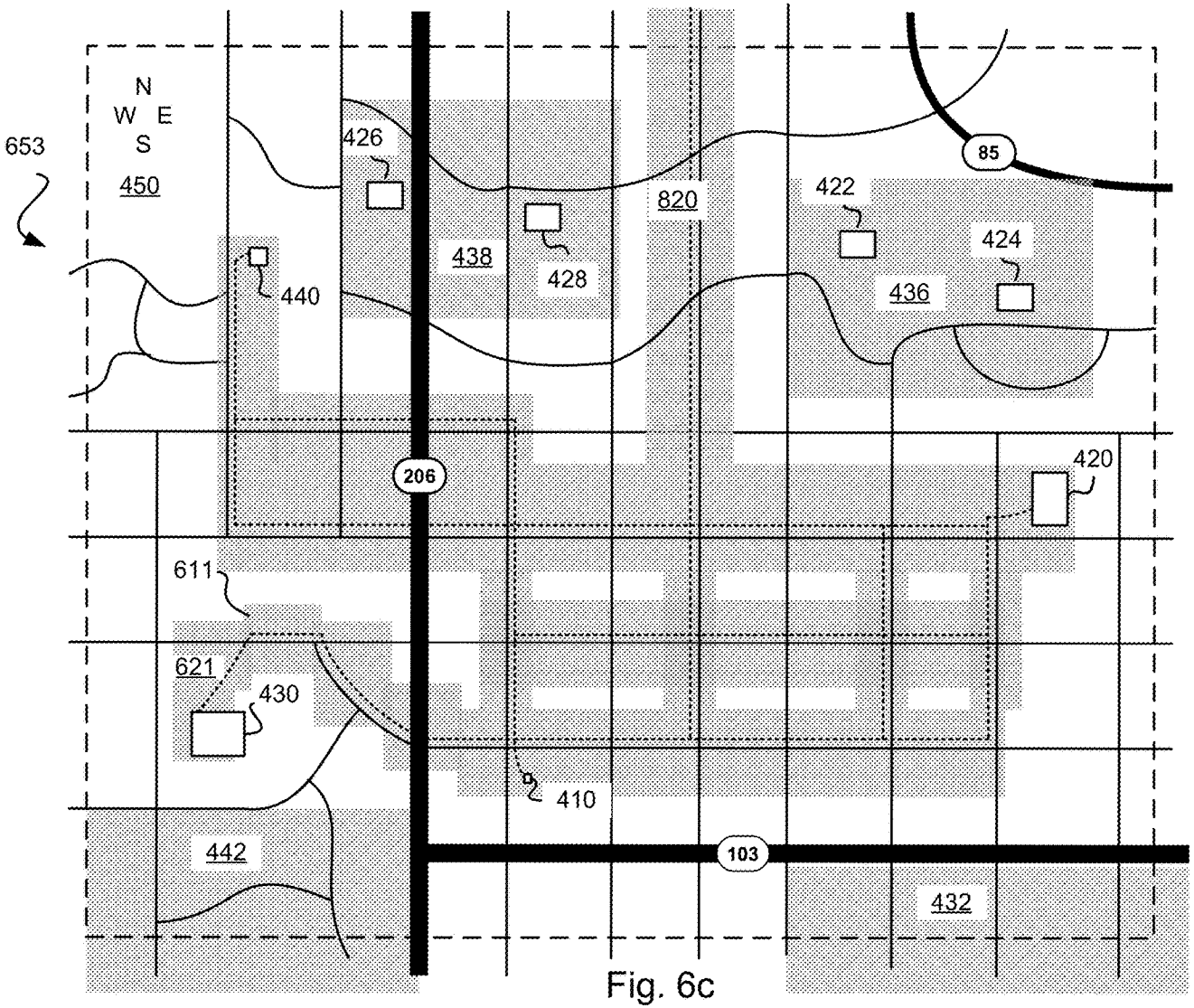

An interim inclusion zone is defined around the recent path as the mean path extended by the variance of the path (block 540). In some cases, the interim inclusion zone may be extended some amount beyond the mean plus the variance to allow a larger degree of freedom. The extension of the interim inclusion zone may be user programmable with the amount of the extension decided as a balance between the perceived danger of the monitored target and a desire to avoid spurious alerts. FIG. 6*b* is an exemplary display 652 that shows a mean path 691 (i.e., the average of a number of instances of recent path 611 that go in somewhat different directions from residence 430 to shopping center 410) and a variance 692 (i.e., the shaded area around mean path 691). Referring back to FIG. 2, the process of flow diagram 200 is repeated until a learning period expires (block 225). Over the learning period (block 225), a number of recent paths are identified and subsequently surrounded by interim inclusion zones (block 220). FIG. 6*c* is an exemplary display 653 depicting a number of recent paths as dashed lines and corresponding interim inclusion zones depicted as stippled areas. As shown, the interim inclusion zones shown as stippled areas cover the various paths that the monitor target would be expected to travel including to/from residence 410, shopping area 430, work 420 and church 440.

Of note, each of the interim inclusion zones includes time information. Thus, for example, the recent paths between residence 410 and work 420 may occur within one hour before a work day is to start and within one hour after the work day is to end. As such, the interim inclusion zones identify not only locations where the monitor target is expected to travel, but also times when the monitor target is expected to be traveling within the given inclusion zone. As shown, display 653 includes all recorded recent paths and corresponding interim inclusion zones generated during the learning period of block 225 of FIG. 2 without limitation of time. Where a time limit is imposed, only some of the interim inclusion zones would be displayed. For example, during the time surrounding the beginning and ending of work, only interim inclusion zones between residence 410 and work 420 would be depicted. As another example, during curfew hours when the monitor target is not allowed to leave residence 410, none of the interim inclusion zones would be depicted. As yet another example, interim inclusion zones between residence 410 and church 440 are only shown during the times surrounding worship services at church 440.

Figure 7:
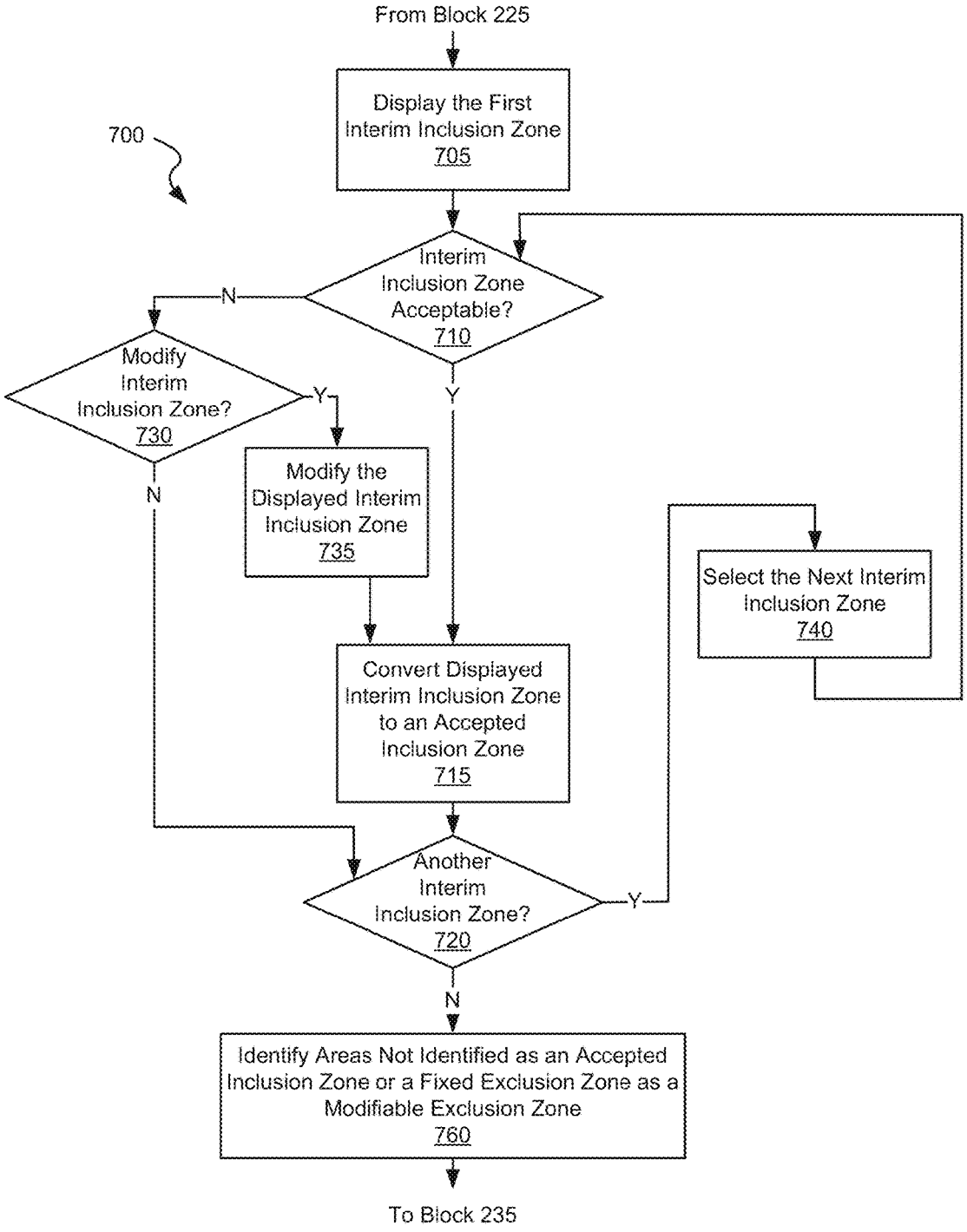
FIG. 7 is a flow diagram depicting an operational mode for validating interim inclusion zones in a monitoring system in accordance with various embodiments of the present invention.
Figure 8A:
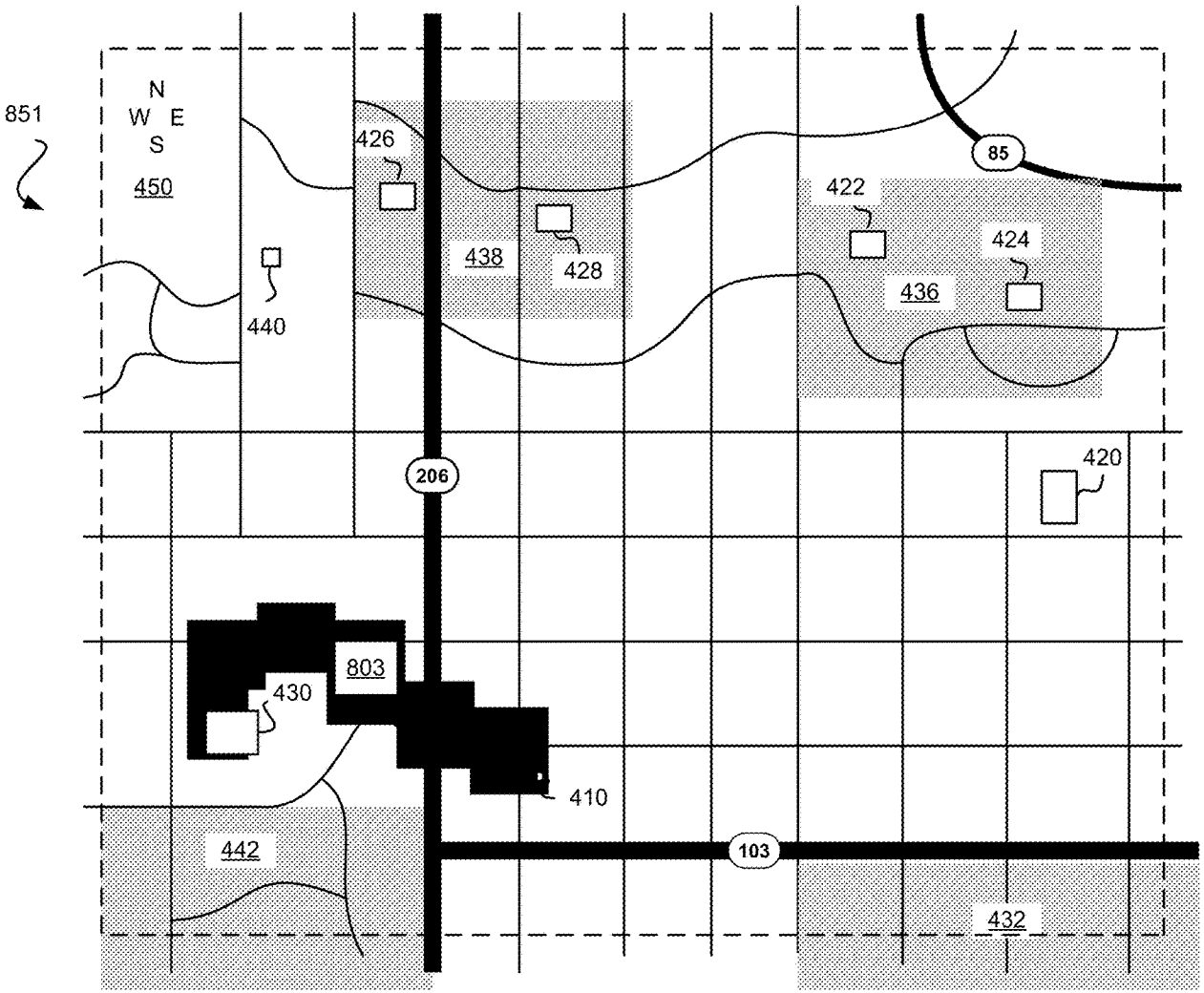
FIGS. 8*a*-8*e* are exemplary displays showing the validation of interim inclusion zones in accordance with some embodiments of the present invention.

Turning to FIG. 7, a flow diagram 700 depicts an operational mode for validating interim inclusion zones in a monitoring system in accordance with various embodiments of the present invention. In some cases, flow diagram 700 may be used to implement the tracking process of block 230 discussed above. Following flow diagram 700, an initial interim inclusion zone is displayed to a verification official (block 705). This may include, for example, displaying a map with the selected interim inclusion zone depicted as a stippled area around a path that the monitor target traveled during the learning period (e.g., block 220 of FIG. 2). The verification official then determines whether the selected interim inclusion zone is acceptable (block 710). Where the selected interim inclusion zone is acceptable (block 710), the displayed interim inclusion zone is converted to an accepted inclusion zone (block 715). FIG. 8*a* is an exemplary display 851 showing an accepted inclusion zone 803 (depicted as a blackened area) extending between residence 410 and shopping center 430. Of note, accepted inclusion zone 803 corresponds to interim inclusion zone 621 of FIG. 6*b*. It should be noted that accepted inclusion zone 803 may be time limited. Such a time limit may include, for example, allowing travel within accepted inclusion zone 803 between the hours of noon and 5:00 pm on Saturday and between 6:00 pm and 8:00 pm on Wednesday. Thus, where display 851 is depicted for a time when the inclusion zone is not active (i.e., anytime other than between the hours of noon and 5:00 pm on Saturday and between 6:00 pm and 8:00 pm on Wednesday), accepted inclusion zone 803 is not shown. Based upon the disclosure provided herein, one of ordinary skill in the art will recognize a variety of time limited accepted inclusion zones, and times when the inclusion zone would not be shown on the corresponding display.

Figure 8B:
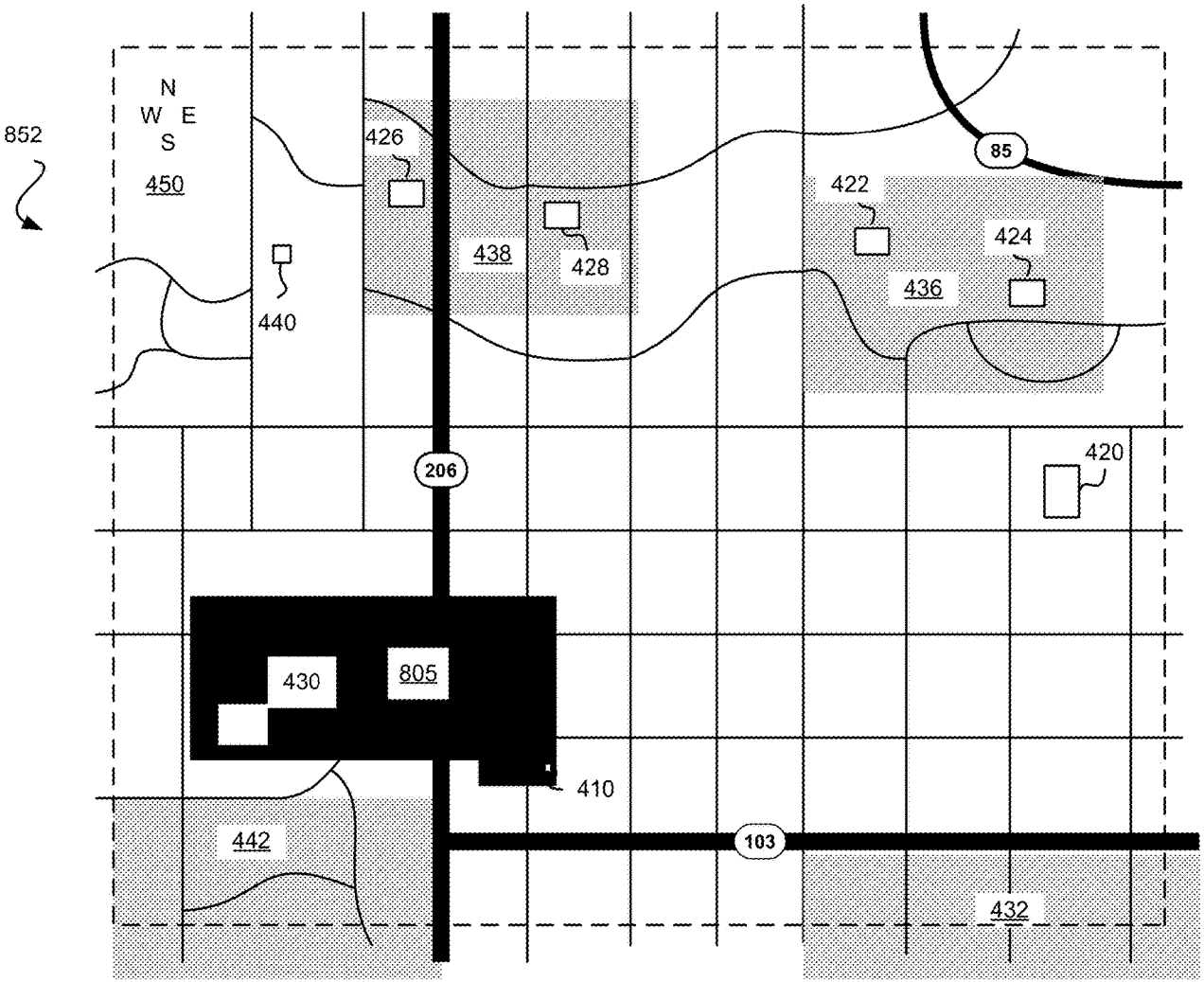

Alternatively, where the interim inclusion zone is not acceptable (block 710), the verification official decides whether the interim inclusion zone is to be modified (block 730). It may be desirable to extend or reduce a time period when the interim inclusion zone is expected to be used, or to increase or decrease the boundaries around an interim inclusion zone. Where it is determined that the interim inclusion zone is to be modified (block 730), the verification official modifies the interim inclusion zone (block 735) and the modified interim inclusion zone is converted to an accepted inclusion zone (block 715). FIG. 8*b* is an exemplary display 852 showing an accepted inclusion zone 805 (depicted as a blackened area) extending between residence 410 and shopping center 430. Of note, accepted inclusion zone 805 corresponds to interim inclusion zone 621 of FIG. 6*b* after modification by the verification official. In this case, the modification was to increase the size of interim inclusion zone 621 to allow for reasonable travel between shopping center 430 and residence 410. It should be noted that accepted inclusion zone 805 may be time limited. Such a time limit may include, for example, allowing travel within accepted inclusion zone 803 between the hours of noon and 5:00 pm on Saturday and between 6:00 pm and 8:00 pm on Wednesday. Thus, where display 852 is depicted for a time when the inclusion zone is not active (i.e., anytime other than between the hours of noon and 5:00 pm on Saturday and between 6:00 pm and 8:00 pm on Wednesday), accepted inclusion zone 805 is not shown. Based upon the disclosure provided herein, one of ordinary skill in the art will recognize a variety of time limited accepted inclusion zones, and times when the inclusion zone would not be shown on the corresponding display.

Where a particular interim inclusion zone is not acceptable and is not going to be modified, the selected interim inclusion zone is not identified as an accepted inclusion zone. An example of such a scenario is interim inclusion zone 820 (shown in FIG. 6*c* and FIG. 8*c*) extending between fixed exclusion zone 436 and fixed exclusion zone 438. This inclusion zone may be ignored by a verification official as it does not extend between essential or acceptable destinations of the monitor target. Where interim inclusion zone 820 is not identified as an accepted inclusion zone, it will be identified as an exclusion zone as more fully discussed below. In some cases, the official is provided with an ability to store a rejected interim inclusion path as a one time exception so that it can be easily reactivated in the future if it is established that there was an acceptable purposes to the inclusion path. For example, such a one time exception may be a visit to a family member in another city that may be repeated at some time in the future.

Where either the interim inclusion zone or modified interim inclusion zone is converted to an accepted inclusion zone (block 715) or where the interim inclusion zone is to be rejected (i.e., modification is not desired) (block 730), it is determined whether another interim inclusion zone remains to be verified (block 720). Where another interim inclusion zone remains to be verified (block 720), the next interim inclusion zone is selected (block 740) and the processes of blocks 710 through 730 are repeated for the selected inclusion zone.

Alternatively, where no other interim inclusion zones remain to be verified (block 720), modifiable exclusion zones are formed as an inverse of the accepted inclusion zones and fixed exclusion zones (block 760). In particular, any location and/or location/time combination that is not either identified as a fixed exclusion zone or an accepted inclusion zone is converted to a modifiable exclusion zone.

Figure 8C:
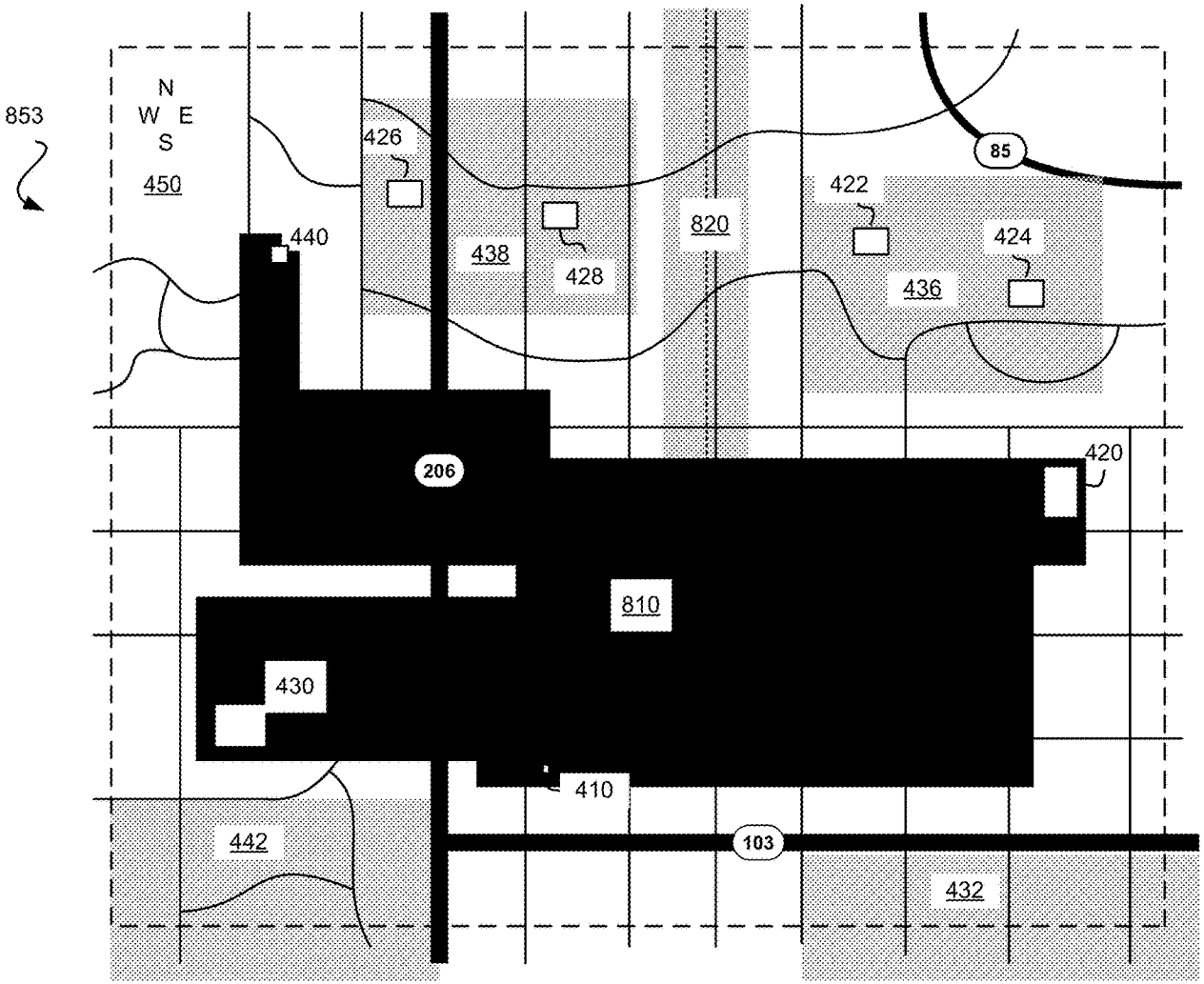

FIG. 8*c* is an exemplary display 853 showing the combination of accepted inclusion zones 810 (depicted as a blackened area) extending between various essential destinations. It should be noted that one or more portions of the combination of accepted inclusion zones 810 may be time limited. Such a time limit may include, for example, allowing travel between residence 410 and church 440 between 1:00 pm and 3:00 pm on Sunday. Thus, where display 853 is depicted for a time when the particular inclusion zone extending between residence 430 and church 440 is not active (i.e., anytime other than between the hours of 1:00 pm and 3:00 pm on Sunday), the particular portion of the accepted inclusion zone would not be shown. Based upon the disclosure provided herein, one of ordinary skill in the art will recognize a variety of time limited accepted inclusion zones, and times when the inclusion zone would not be shown on the corresponding display.

Figure 8D:
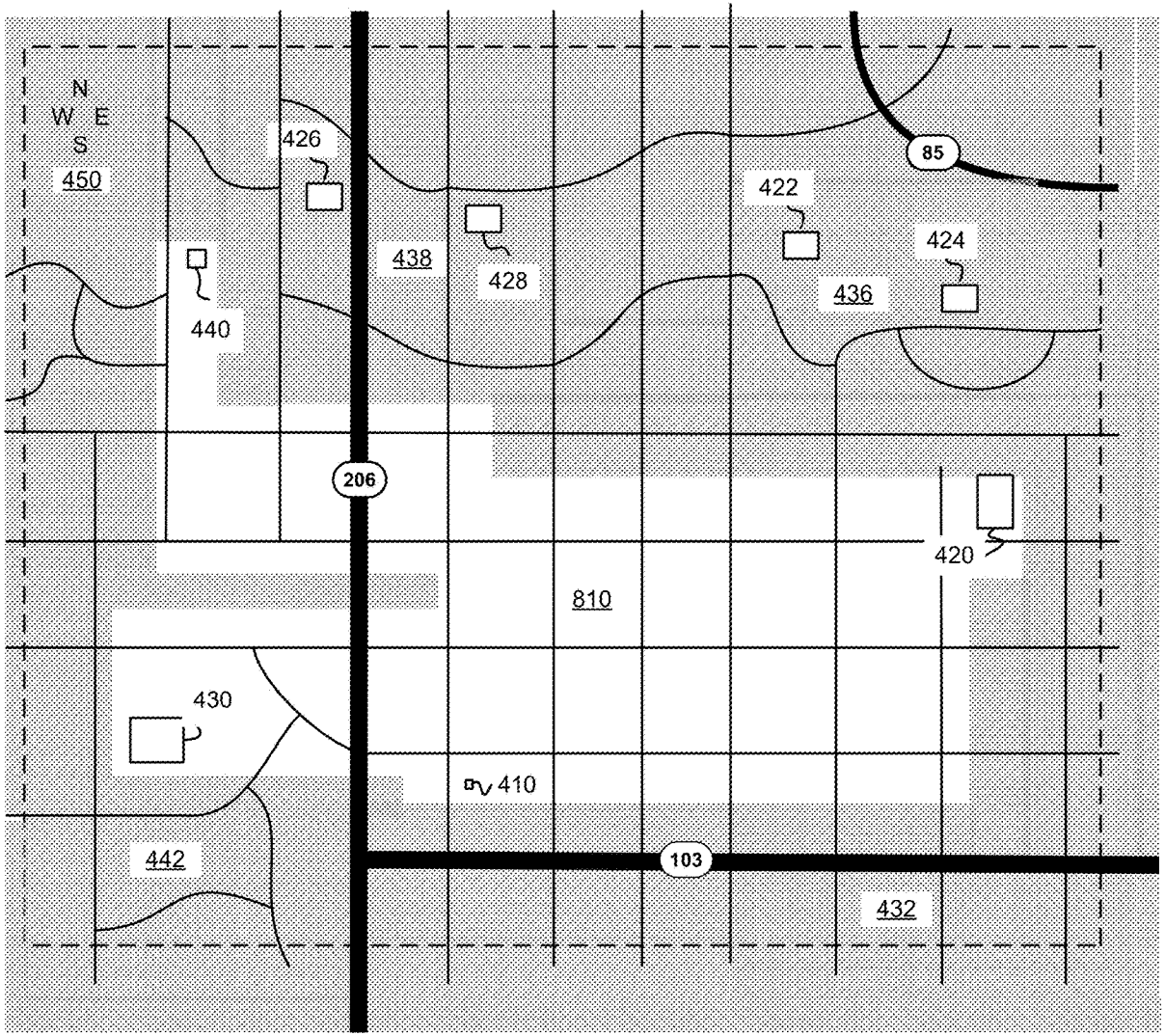
Figure 8E:
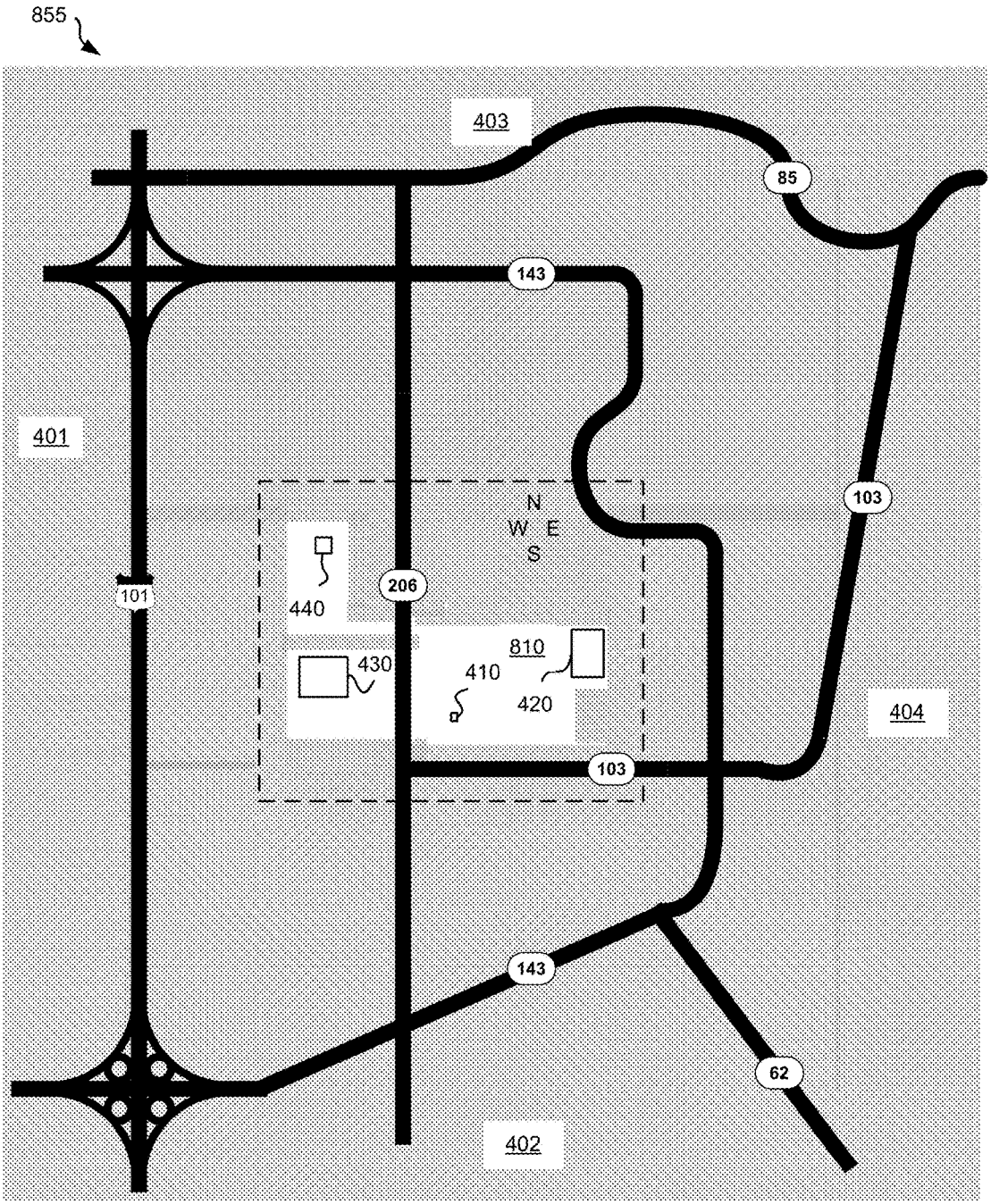

FIG. 8*d* is an exemplary display 854 showing the resulting exclusion zones within central region 450 after the processes of block 760 are performed, and FIG. 8*e* is an exemplary display 855 showing the resulting exclusion zones including central region 450 after the processes of block 760 are performed. Of note, the fixed exclusion zones (e.g., zones 401, 402, 403, 404, 432, 436, 438, 442) are shown as patterned regions. Modifiable exclusion zones are depicted as cross-hatched regions, and the combination of accepted inclusion zones 810 are shown without patterning. It should be noted that one or more portions of the combination of accepted inclusion zones 810 may be time limited. Such a time limit may include, for example, allowing travel between residence 410 and church 440 between 1:00 pm and 3:00 pm on Sunday.

Thus, where display 854 or display 855 is depicted for a time when the particular inclusion zone extending between residence 410 and church 440 is not active (i.e., anytime other than between the hours of 1:00 pm and 3:00 pm on Sunday), the particular portion of the accepted inclusion zone would be shown as a modifiable exclusion zone (i.e., shown with a cross-hatched pattern). Based upon the disclosure provided herein, one of ordinary skill in the art will recognize a variety of time limited accepted inclusion zones, and times when the inclusion zone would not be shown on the corresponding display.

Figure 9:
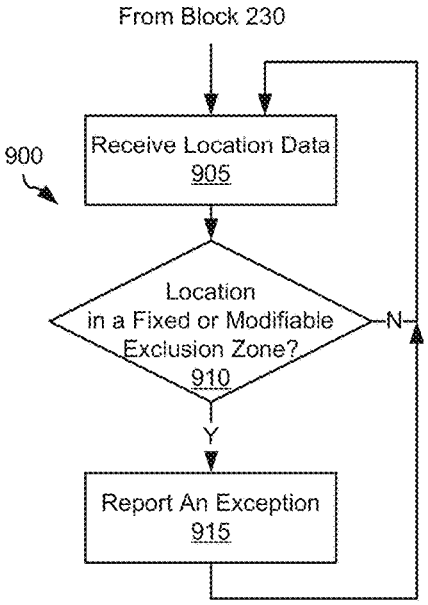
FIG. 9 is a flow diagram showing an operational mode for monitoring movement in a monitoring system in accordance with one or more embodiment of the present invention.

Turning to FIG. 9, a flow diagram 900 depicts an operational mode for tracking movement in a monitoring system in accordance with one or more embodiment of the present invention. In some cases, flow diagram 900 may be used to implement the tracking process of block 235 discussed above. Following flow diagram 900, location data is received related to a monitor target (block 905). This location and time information may be received at a central monitoring location from a monitor device associated with the monitor target. As an example, where the monitor target is a human, the monitor device may be a monitor bracelet similar to that discussed above in relation to FIG. 1. Based upon the disclosure provided herein, one of ordinary skill in the art will recognize a variety of approaches and devices that may be used to receive location and time information about a monitor target. It is then determined whether the received location and time information indicates that a monitor target has ventured into either a fixed exclusion zone or a modifiable exclusion zone (block 910). For example, where a fixed exclusion zone is defined such that it precludes the monitor target from venturing within the fixed exclusion zone regardless of time, an exception or alert is generated and reported when the monitor target moves within the fixed exclusion zone (block 915). As another example, where a modifiable exclusion zone prohibits travel by the monitor target within the zone except between the hours of 8:00 am and 9:00 am and between the hours of 5:00 pm and 6:00 pm Monday through Friday, an exception or alert is generated and reported whenever the monitor target moves within the modifiable exclusion zone outside of the hours between 8:00 am and 9:00 am and between the hours of 5:00 pm and 6:00 pm Monday through Friday (block 915). It should be noted that the aforementioned are merely examples, and that one of ordinary skill in the art will recognize a variety of fixed exclusion zones and modifiable exclusion zones, and bases that a monitor target could violate the exclusion zones and thereby trigger the generation of an exception or an alert to an alert recipient system.

Figure 10:
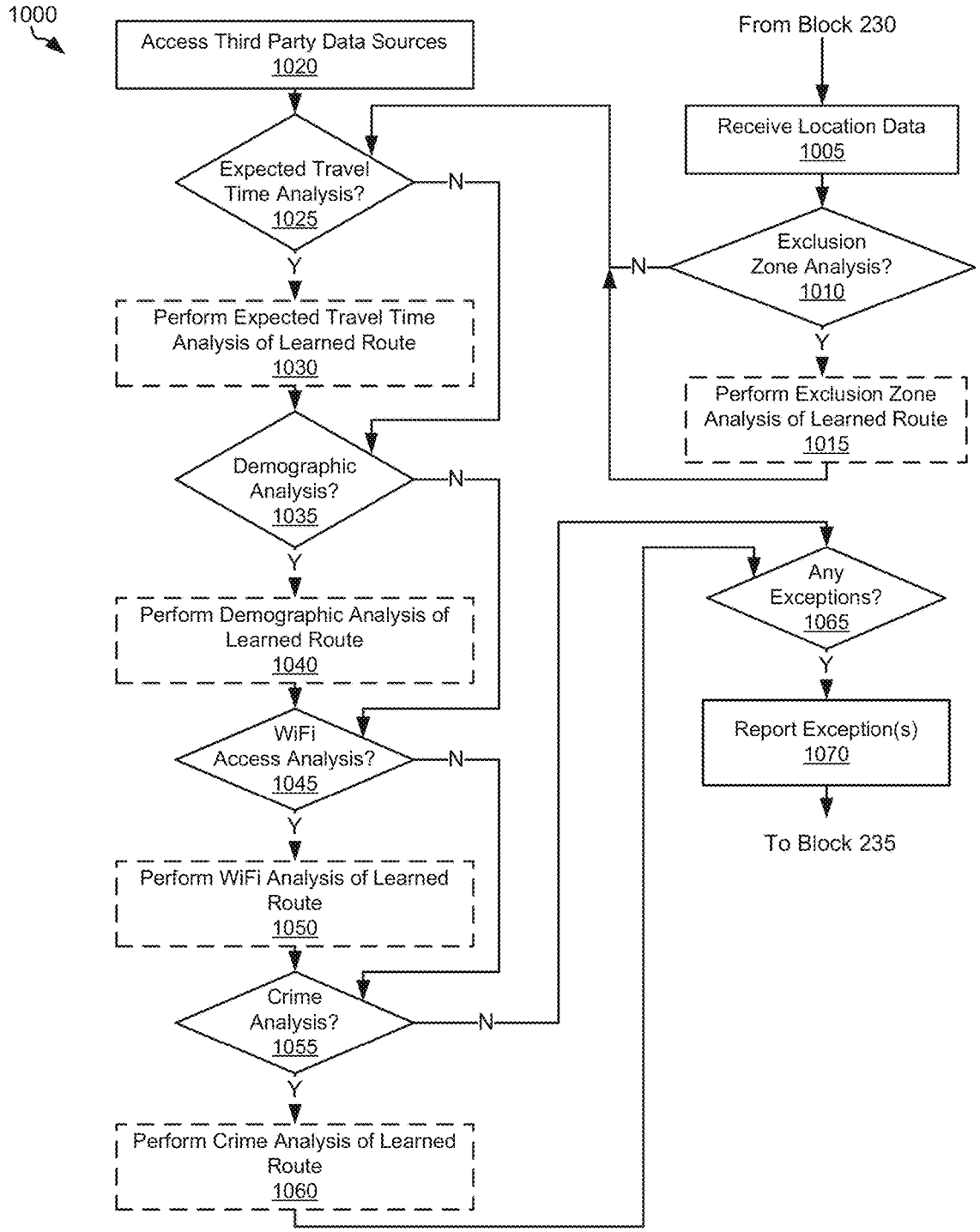
FIG. 10 is a flow diagram showing an operational mode for initializing and operating a monitoring system including use of informational databases to flag potential concerns in accordance with various embodiments of the present invention.

Turning to FIG. 10, a flow diagram 1000 shows an operational mode for initializing and operating a monitoring system including using a informational databases to flag potential concerns in accordance with various embodiments of the present invention. Following flow diagram 1000, location data is received related to a monitor target (block 1005). This location and time information may be received at a central monitoring location from a monitor device associated with the monitor target. As an example, where the monitor target is a human, the monitor device may be a monitor bracelet similar to that discussed above in relation to FIG. 1. Based upon the disclosure provided herein, one of ordinary skill in the art will recognize a variety of approaches and devices that may be used to receive location and time information about a monitor target. In addition, third party data sources are accessed (block 1020). These third party data sources may include, but are not limited to, demogramphic databases, databases indicating the location of publicly available Internet access points, mapping and traffic information, and/or crime scene databases.

It is determined whether exclusion zone analysis is to be performed (block 1010). This analysis includes determining whether the monitored individual has moved into an exclusion (block 1015). This may be done similar to that discussed above in relation to FIG. 9. Where either exclusion zone analysis is not selected (block 1010) or the exclusion zone analysis is completed (block 1015), it is determined whether expected travel time analysis is to be performed (block 1025). Selection of expected travel time analysis may be user programmable. Where expected travel time analysis it to be performed (block 1025), the process of expected time analysis is performed (block 1030). An example of such expected time analysis capable of generating one or more exceptions is discussed more fully below in relation to FIG. 11.

Where expected time analysis is not selected (block 1025) or the expected time analysis is completed (block 1030), it is determined whether demographic analysis is to be performed (block 1035). Selection of demographic analysis may be user programmable. Where demographic analysis it to be performed (block 1035), the process of demographic analysis is performed (block 1040). An example of such demographic analysis capable of generating one or more exceptions is discussed more fully below in relation to FIG. 12. Where demographic analysis is not selected (block 1035) or the demographic analysis is completed (block 1040), it is determined whether an Internet access analysis (e.g., WiFi availability) is to be performed (block 1045). Selection of Internet access analysis may be user programmable. Where Internet access analysis it to be performed (block 1045), the process of Internet access analysis is performed (block 1050). An example of such Internet access analysis capable of generating one or more exceptions is discussed more fully below in relation to FIG. 13. Where Internet access analysis is not selected (block 1045) or the Internet access analysis is completed (block 1050), it is determined whether a crime analysis is to be performed (block 1055). Selection of crime analysis may be user programmable. Where crime analysis it to be performed (block 1055), the process of crime analysis is performed (block 1060). An example of such crime analysis capable of generating one or more exceptions is discussed more fully below in relation to FIG. 14.

Where crime analysis is not selected (block 1045) or the Internet access analysis is completed (block 1050), it is determined whether any of the exclusion zone analysis, expected travel time analysis, demographic analysis, Internet access analysis, or crime analysis generated an exception(s) (block 1065). Where one or more exceptions were generated (block 1065), those exceptions are reported to the recipient system (block 1070).

Figure 11:
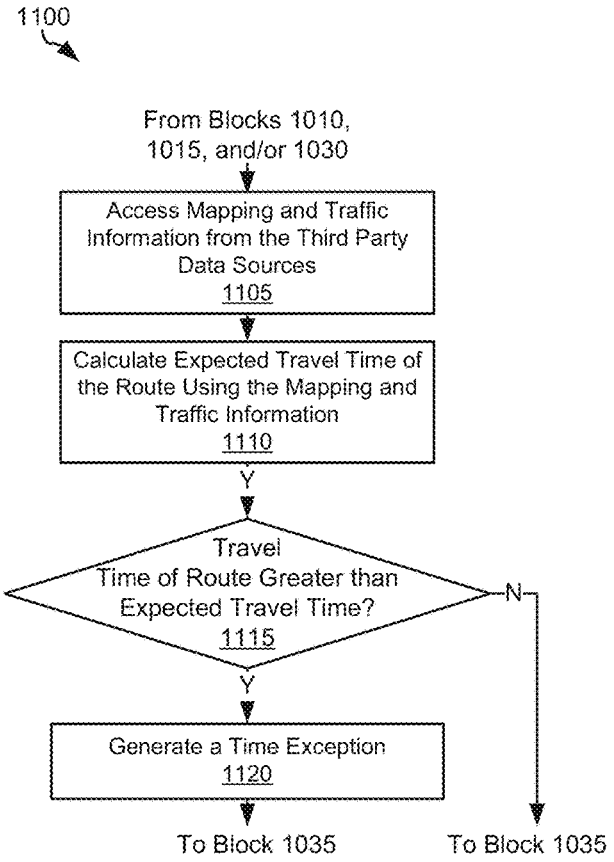
FIG. 11 is a flow diagram depicting use of mapping and traffic information in accordance with some embodiments of the present invention for performing monitoring of target movement.

Turning to FIG. 11, a flow diagram 1100 depicts use of mapping and traffic information in accordance with some embodiments of the present invention for performing monitoring of target movement. In some cases, flow diagram 1100 may be used to implement the expected travel time analysis of block 1030 discussed above in relation to flow diagram 1000. Following flow diagram 1100, mapping and traffic information is accessed from the third party data sources (block 1105). This may include accessing the information from the third party from which an expected travel time can be estimated, or providing end points of the learned route to a third party which returns the expected travel time based thereon (block 1110). It is determined if the time used by the monitored individual exceeds the expected time based (block 1115). Where the travel time used exceeds the expected travel time (block 1115), a time exception is generated (block 1120). As discussed above in relation to flow diagram 1000 of FIG. 10, the exception is ultimately reported to the recipient system.

Figure 12:
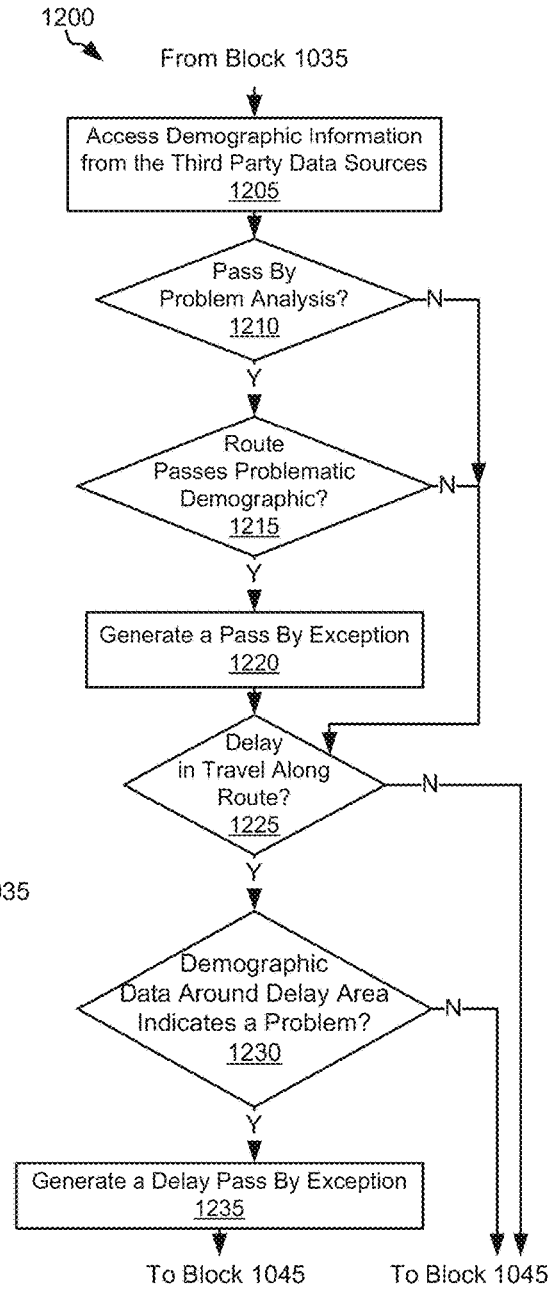
FIG. 12 is a flow diagram depicting use of demographic information in accordance with some embodiments of the present invention for performing monitoring of target movement.

Turning to FIG. 12, a flow diagram 1200 depicts use of use of demographic information in accordance with some embodiments of the present invention for monitoring of target movement. In some cases, flow diagram 1200 may be used to implement the demographic analysis of the learned route of block 1040 discussed above in relation to flow diagram 1000. Following flow diagram 1100, demographic information is accessed from the third party data sources (block 1205). It is determined whether pass by analysis is desired (block 1210). Such pass by analysis is limited to determining whether the monitored individual is passing by problematic demographics regardless of how long the monitored target may delay their travel while passing through the demographic. Where pass by problem analysis is desired (block 1210), it is determined whether the learned path passes through a problematic demographic (block 1215). For example, a monitored target may be an alcoholic in which case a problematic demographic may be an area that includes liquor stores or bars. As another example, a monitored target may be a compulsive gambler in which case a problematic demographic may be an area that includes one or more casinos. As yet another example, a monitored target may be a violent felon in which case a problematic demographic may include gun shops or pawn shops. As yet another example, a monitored target may be a child sex offender in which case a problematic demographic may include toy stores, video arcades, schools, or other locations frequented by children. Where a problematic demographic is identified (block 1215), a pass by exception is generated (block 1220). As discussed above in relation to flow diagram 1000 of FIG. 10, the exception is ultimately reported to the recipient system.

Alternatively, where either a pass by problem analysis is not desired (block 1210), a problematic demographic is not identified (block 1215), or generation of a pass by exception is completed (block 1220), it is determined whether there is a delay in travel along the learned route (block 1225). A delay may be any stopping along the learned route for a period longer than a programmable threshold time. Where there is a delay (block 1225), the demographic data of the area around the delay is queried to determined whether a problem is indicated (block 1230). Where a problem is indicated (block 1230), a delay pass by exception is generated (block 1235). By doing this, when a zone is found to be frequented by a monitored individual, an analysis of the area including the business types, household statistics including as income levels, education, and number of children registered in the household, parks, schools, day care facilities, and even prison or halfway houses can be located to recognize suspicious behavior near locations with an elevated risk. Problematic businesses may include, but are not limited to, liquor stores, bars, casinos, gun sales, pawn shops, and toy stores. As discussed above in relation to flow diagram 1000 of FIG. 10, the exception is ultimately reported to the recipient system.

Figure 13:
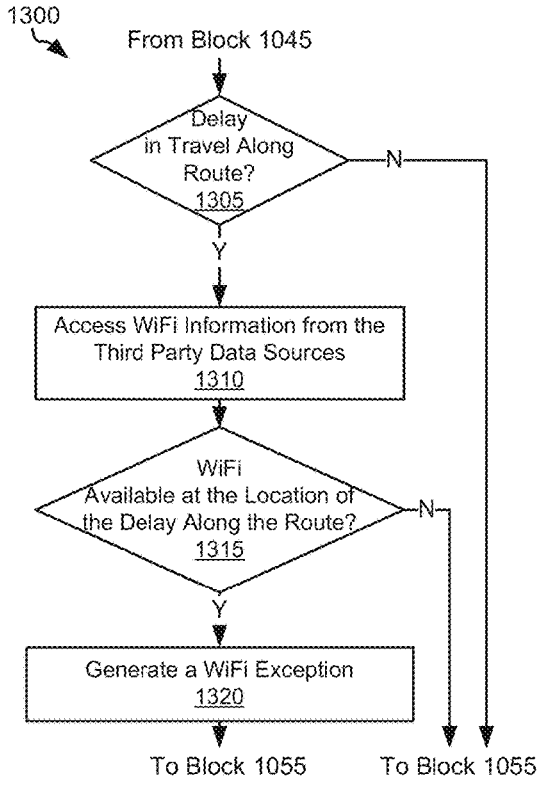
FIG. 13 is a flow diagram depicting use of Internet access information in accordance with some embodiments of the present invention for performing monitoring of target movement and FIG. 14 is a flow diagram depicting use of crime scene information in accordance with some embodiments of the present invention performing monitoring of target movement.

Turning to FIG. 13, a flow diagram 1300 depicts use of Internet access information in accordance with some embodiments of the present invention for performing monitoring of target movement. In some cases, flow diagram 1300 may be used to implement the WiFi analysis of block 1050 discussed above in relation to flow diagram 1000. Following flow diagram 1300, it is determined whether there is a delay in travel along the learned route (block 1305). A delay may be any stopping along the learned route for a period longer than a programmable threshold time. Where there is a delay along the learned route (block 1305), Internet access information is accessed from the third party data sources (block 1310). This may include accessing the information from the third party including identifications of locations where public Internet access is available. It is then determined whether the location corresponding to the delay along the route is near one of the Internet access points (block 1315). Where there is Internet access near the delay location (block 1315), a WiFi exception is generated (block 1320). As discussed above in relation to flow diagram 1000 of FIG. 10, the exception is ultimately reported to the recipient system.

Figure 14:
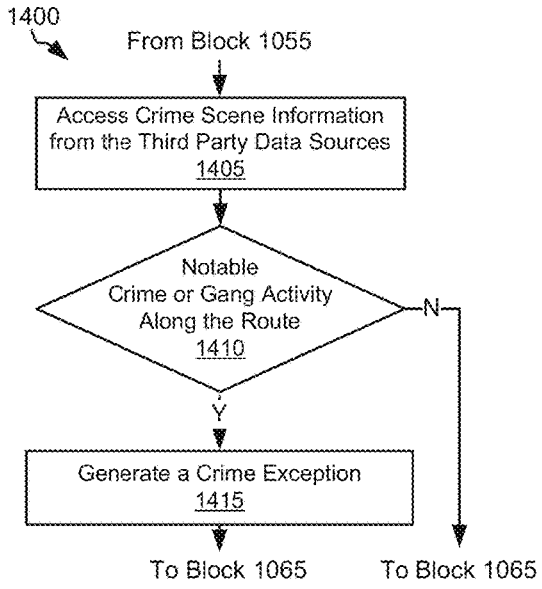

Turning to FIG. 14, a flow diagram 1400 depicts use of crime scene information in accordance with some embodiments of the present invention for performing monitoring of target movement. In some cases, flow diagram 1400 may be used to implement the crime analysis of block 1060 discussed above in relation to flow diagram 1000. Following flow diagram 1400, crime information is accessed from the third party data sources (block 1405). This may include accessing the information from the third party including identifications of locations where crimes are committed, and gang activity is reported. It is determined whether any notable crime or gang activity is reported along the learned route (block 1410). Where such activity is reported (block 1410), a crime exception is generated (block 1415). As discussed above in relation to flow diagram 1000 of FIG. 10, the exception is ultimately reported to the recipient system.

Various embodiments of the present invention provide an ability for a verification official or monitoring official to manually modify the modifiable exclusion zones and/or fixed exclusion zones related to the particular monitor target. Such modification may involve changing times when one or more modifiable exclusion zone is active, the region covered by one or more modifiable exclusion zones; the incorporation of one or more additional fixed exclusion zones, and/or the elimination of one or more fixed exclusion zones. Such modifications may be relatively simple when compared with the prospect of manually entering hundreds or even thousands of exclusion zones or inclusion zones where the above described learn/verification process is not available. Where there is need to do substantial revisions of the modifiable exclusion zones and/or fixed exclusion zones, the above described learn/verification process may be repeated. Such a need for substantial revision may occur where, for example, the residence of a monitor target changes or the monitor target changes jobs. In some cases, such a process of starting over may be aided by starting with the prior zones or paths already learned, verified, and monitored for that client. In this case the process of learning a schedule/route on a particular day may not necessarily over ride the existing schedule.

In conclusion, the present invention provides for novel systems, devices, and methods for monitoring individuals and/or assets. While detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A monitoring system, the monitoring system comprising:

a monitor device associated with a monitor target, wherein the monitor device is operable to transmit information about the monitor target to a central monitoring system, wherein the central monitoring system includes a computer and a non-transitory computer readable medium, and wherein the non-transitory computer readable medium includes instructions executable by the computer to:

receive the information about the monitor target, wherein the information about the monitor target includes a plurality of time stamped locations along a path traveled by the monitor target;

use the plurality of time stamped locations to identify a delay along the path traveled by the monitor target and a location of the delay, wherein the location of the delay is at an allowed area of travel;

receive information from one or more databases, wherein the information from the one or more databases identifies at least one attribute corresponding to the location of the delay;

analyze the information from the one or more databases, wherein it is determined that the location of the delay is problematic; and issue an alert based at least in part on the delay along the path traveled by the monitor target and the determination that the location of the delay is problematic.

2. The monitoring system of claim 1, wherein the one or more databases includes demographic data, and wherein the information from the one or more databases is a subset of the demographic data.

3. The monitoring system of claim 2, wherein the subset of the demographic data identifies locations frequented by children, and wherein an attribute of the monitor target identifies the monitored target as precluded from being near children.

4. The monitoring system of claim 2, wherein the subset of the demographic data identifies businesses selling alcohol, and wherein an attribute of the monitor target identifies the monitored target as precluded from consuming alcohol.

5. The monitoring system of claim 1, wherein the one or more databases includes mapping and traffic information, and wherein the non-transitory computer readable medium further includes instructions executable by the computer to:

calculate an estimated time to travel the path traveled by the monitor target;

compare the estimated time to travel with an actual time of travel by the monitor target, wherein the actual time of travel exceeds the estimated time to travel by a threshold amount; and issue an alert indicating a time violation based at least in part on the actual time of travel exceeding the estimated time to travel by the threshold amount.

6. The monitoring system of claim 5, wherein the threshold amount is programmable.

7. The monitoring system of claim 5, wherein the threshold amount is zero.

8. The monitoring system of claim 1, wherein the one or more databases includes Internet access locations, and wherein the information from the one or more databases is a subset of the Internet access locations.

9. The monitoring system of claim 1, wherein the one or more databases includes crime scene data, and wherein the information from the one or more databases is a subset of the crime scene data.

10. The monitoring system of claim 1, wherein the system further comprises:

an alert recipient system operable to receive the alert and to direct the alert to a device associated with an official overseeing the monitor target.

11. The monitoring system of claim 1, wherein identifying the delay along the path traveled by the monitor target and the location of the delay comprises:

based upon the plurality of locations and time stamps along the path traveled by the monitor target, determining a time period that the monitor target was not moving and a location corresponding to the time period; and comparing the time period to a threshold time.

12. The monitoring system of claim 11, wherein the threshold time is programmable.

13. A monitoring system, the monitoring system comprising:

a central monitoring system including at least a computer and a non-transitory computer readable medium, wherein the non-transitory computer readable medium includes instructions executable by the computer to:

receive location information about a monitor target wherein the information about the monitor target includes a plurality of time stamped locations along a path traveled by the monitor target;

compare the location information with an allowed area of travel, wherein it is determined that the monitor target is within the allowed area of travel;

use the plurality of time stamped locations to identify a delay along the path traveled by the monitor target and a location of the delay;

receive information from one or more databases, wherein the information from the one or more databases identifies at least one attribute corresponding to the location of the delay;

analyze the information from the one or more databases, wherein it is determined that the location of the delay is problematic; and issue an alert based at least in part on the determination that the location of the delay is problematic.

14. The monitoring system of claim 13, wherein the one or more databases includes mapping and traffic information, and wherein the non-transitory computer readable medium further includes instructions executable by the computer to:

calculate an estimated time to travel the path traveled by the monitor target;

compare the estimated time to travel with an actual time of travel by the monitor target, wherein the actual time of travel exceeds the estimated time to travel by a threshold amount; and issue an alert indicating a time violation based at least in part on the actual time of travel exceeding the estimated time to travel by the threshold amount.

15. The monitoring system of claim 14, wherein the threshold amount is programmable.

16. The monitoring system of claim 14, wherein the threshold amount is zero.

17. The monitoring system of claim 13, wherein the one or more databases includes Internet access locations, and wherein the information from the one or more databases is a subset of the Internet access locations.

18. The monitoring system of claim 13, wherein the one or more databases includes crime scene data, and wherein the information from the one or more databases is a subset of the crime scene data.

19. The monitoring system of claim 13, wherein the system further comprises:

an alert recipient system operable to receive the alert and to direct the alert to a device associated with an official overseeing the monitor target.

20. The monitoring system of claim 13, wherein identifying the delay along the path traveled by the monitor target and the location of the delay comprises:

based upon the plurality of locations and time stamps along the path traveled by the monitor target, determining a time period that the monitor target was not moving and a location corresponding to the time period; and comparing the time period to a threshold time.

21. The monitoring system of claim 20, wherein the threshold time is programmable.

22. The monitoring system of claim 13, wherein the one or more databases includes demographic data, and wherein the information from the one or more databases is a subset of the demographic data.

23. The monitoring system of claim 22, wherein the subset of the demographic data identifies locations frequented by children, and wherein an attribute of the monitor target identifies the monitored target as precluded from being near children.

24. The monitoring system of claim 22, wherein the subset of the demographic data identifies businesses selling alcohol, and wherein an attribute of the monitor target identifies the monitored target as precluded from consuming alcohol.

25. A monitoring system, the monitoring system comprising:

a central monitoring system including at least a computer and a non-transitory computer readable medium, wherein the non-transitory computer readable medium includes instructions executable by the computer to:

receive location information about a monitor target;

based upon the location information, determine a period of time that the monitor target is not moving in an allowed area of travel;

identify a location where the period of time that the monitor target is not moving occurs;

receive information from one or more databases, wherein the information from the one or more databases identifies at least one attribute corresponding to the location;

analyze the information from the one or more databases, wherein it is determined that the location is problematic; and issue an alert based at least in part on the determination that the location is problematic.

26. The monitoring system of claim 25, wherein the one or more databases includes demographic data, and wherein the information from the one or more databases is a subset of the demographic data.

27. The monitoring system of claim 26, wherein the subset of the demographic data identifies locations frequented by children, and wherein an attribute of the monitor target identifies the monitored target as precluded from being near children.

28. The monitoring system of claim 26, wherein the subset of the demographic data identifies businesses selling alcohol, and wherein an attribute of the monitor target identifies the monitored target as precluded from consuming alcohol.

29. The monitoring system of claim 25, wherein the one or more databases includes mapping and traffic information, and wherein the non-transitory computer readable medium further includes instructions executable by the computer to:

calculate an estimated time to travel the path traveled by the monitor target;

compare the estimated time to travel with an actual time of travel by the monitor target, wherein the actual time of travel exceeds the estimated time to travel by a threshold amount; and issue an alert indicating a time violation based at least in part on the actual time of travel exceeding the estimated time to travel by the threshold amount.

30. The monitoring system of claim 29, wherein the threshold amount is programmable.

31. The monitoring system of claim 29, wherein the threshold amount is zero.

* * * * *